US007209681B2

(12) United States Patent
Yamada et al.

(10) Patent No.: US 7,209,681 B2
(45) Date of Patent: Apr. 24, 2007

(54) ELECTROPHOTOGRAPHIC APPARATUS FOR FORMING A COLOR IMAGE UTILIZING LED ARRAY EXPOSURE DEVICES

(75) Inventors: Shintaro Yamada, Chiyoda (JP); Toru Miyasaka, Tsuchiura (JP); Taichiro Yamashita, Tsuchiura (JP); Kenji Asuwa, Toride (JP); Masahiro Yagi, Kashiwa (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 10/695,945

(22) Filed: Oct. 30, 2003

(65) Prior Publication Data

US 2004/0091290 A1 May 13, 2004

(30) Foreign Application Priority Data

Oct. 31, 2002 (JP) ..... 2002-317116
Jul. 31, 2003 (JP) ..... 2003-204684

(51) Int. Cl.
*G03G 15/04* (2006.01)
*G03G 15/01* (2006.01)

(52) U.S. Cl. ..... 399/119; 399/299

(58) Field of Classification Search ..... 399/119, 399/222, 223, 298, 299
See application file for complete search history.

(56) References Cited

U.S. PATENT DOCUMENTS 5,386,286 A * 1/1995 Kinouchi et al. ..... 399/299
5,475,478 A * 12/1995 Nishimura et al. ..... 399/119
5,491,537 A * 2/1996 Suzuki et al. ..... 399/262
5,671,461 A * 9/1997 Ishii ..... 399/27
5,765,082 A * 6/1998 Numazu et al. ..... 399/299
6,381,428 B1 4/2002 Yamamoto et al.
6,477,348 B2 11/2002 Miyamoto et al.
6,603,940 B2 * 8/2003 Funayama et al. ..... 399/119
6,628,914 B1 * 9/2003 Wang et al. ..... 399/258
6,681,094 B2 * 1/2004 Horrall et al. ..... 399/299
6,798,430 B2 * 9/2004 Sato ..... 399/299
6,799,011 B2 * 9/2004 Abe et al. ..... 399/299
6,895,211 B2 5/2005 Yamashita et al.
2002/0003977 A1 * 1/2002 Kanekura et al. ..... 399/298

FOREIGN PATENT DOCUMENTS

| | | |
|---|---|---|
| JP | A-8-137179 | 5/1966 |
| JP | A-2-135470 | 5/1999 |
| JP | A-11-167278 | 6/1999 |
| JP | A-11-344858 | 12/1999 |
| JP | A-5-11584 | 9/2000 |
| JP | 2001-002330 | 1/2001 |
| JP | A-2001-296713 | 10/2001 |
| JP | A-2001-356548 | 12/2001 |

* cited by examiner

*Primary Examiner*—Sandra L. Brase
(74) *Attorney, Agent, or Firm*—Antonelli, Terry, Stout & Kraus, LLP.

(57) ABSTRACT

An electrophotographic apparatus includes a plurality of image forming devices, wherein each image forming device includes a developing device having a tip end part and a toner storage part coupled to the tip end part. A thickness of the tip end part is smaller than a thickness of the toner storage part. An exposure device, which is an LED array, is arranged near the tip end part.

16 Claims, 14 Drawing Sheets

ELECTROPHOTOGRAPHIC APPARATUS FOR FORMING A COLOR IMAGE UTILIZING LED ARRAY EXPOSURE DEVICES

BACKGROUND OF THE INVENTION

The present invention relates to an image forming apparatus, such as duplicating machines, printers, facsimile apparatuses, and the like, for forming a color image with the use of electro-photography, and more particular, to an electrophotographic apparatus for forming a color image making use of a plurality of color toners.

With an electrophotographic system, light from exposure means is irradiated on an evenly charged photosensitive body to form an electrostatic latent image corresponding to image data, toner is caused to adhere to the electrostatic latent image on the photosensitive body to develop a toner image, and the toner image is transferred to a recording medium to be fixed thereto.

Here, while an explanation will be given to the case where a recording medium is a paper sheet, the recording medium includes all sheet-shaped recording media formed of various materials such as plastics, and the like, as well as paper.

In forming a color image, a plurality of color toners such as yellow Y, magenta M, cyan C, black B, or the like are superposed to form the image.

Color image forming systems include a repetitive developing system of repetitively developing respective color toners on a single photosensitive body to form a color image, and a simultaneous developing system of simultaneously developing respective color toners on a plurality of photosensitive bodies to form a color image.

The repetitive developing system is one, in which a single photosensitive body is used to form a color image, and a four-revolution system is an example thereof.

The four-revolution system is one, in which a plurality of developing means for developing respective different color toners and an intermediate transfer body are arranged around a photosensitive body and color images formed on the photosensitive body are successively transferred color by color to the intermediate transfer body (see, for example, JP-A-8-137179).

Such transfer is repeated every color to superpose a plurality of color toner images on the intermediate transfer body, and then the color toner images on the intermediate transfer body are transferred to a medium to fix a color image thereon.

With the four-revolution system, color toner images of, for example, yellow Y, magenta M, cyan C, and black B are successively formed color by color on a photosensitive body and superposingly transferred to an intermediate transfer body, so that image formation takes time four times that taken in the case where a monochrome image is formed.

The simultaneous developing system is one, in which toner images are substantially simultaneously formed on a plurality of photosensitive bodies corresponding to several colors, and are transferred correspondingly to conveyance of a sheet to form a color image, and which is also called a tandem system (see, for example, JP-A-2001-356548).

With the tandem system, image forming means including a photosensitive body, charging means, exposure means, developing means, and cleaner means is independently provided every color, so that four sets of image forming means must be provided in the case where a color image is formed with the use of color toners of yellow Y, magenta M, cyan C, and black B.

With the tandem system, four sets of independent image forming means are used to form toner images substantially simultaneously, and the toner images are transferred to an intermediate transfer body, or a sheet. With the tandem system, color images are simultaneously superposed on one another, so that a color image can be formed in substantially the same time as that taken in the case where a monochrome image is formed, and so the system is suited for high-speed printing.

In recent years, demands for colored documents have been greatly increased in offices and color printers are being rapidly spread. Also, high-speed printing is wanted, and attention is paid to color printers of the tandem system.

Since color printers of the tandem system comprise four sets of image forming means, however, they are difficult to be miniaturized and large in size as compared with color printers of the repetitive developing system.

An example of conventional color printers of the tandem system is of a construction, in which four sets of independent image forming means making use of LED arrays as exposure means are stacked vertically and arranged, as disclosed in JP-A-2001-356548. In this example, exposure means are fixedly mounted in order to ensure accuracy in exposure, and developing means, that is, process cartridges are susceptible to taking out and putting in.

There has been proposed a construction, in which exposure means are fixedly mounted centrally of a body of an electrophotographic apparatus and light beams from the exposure means are irradiated on photosensitive bodies through spaces formed between charging means, developing means, cleaner means, and so on, which can be mounted to and dismounted from the bodies (see, for example, JP-A-2001-296713).

As to a toner regulatory blade for forming a thin toner layer on a developing roller, there is disclosed a configuration of a toner regulatory blade comprising an elastic blade made of a silicone compound or a fluorine compound and mounted on a tip end of a leaf spring (see, for example, JP-A-5-11584).

There is disclosed a configuration of a toner regulatory blade having a tip end thereof once bent so that a divergence, $30° \leqq \theta \leqq 90°$, is formed between the blade tip end, which comes into contact with a developing roller in a direction following rotation of the developing roller, that is, in the same direction as a direction, in which a surface of the developing roller moves, and the developing roller (see, for example, JP-A-11-344858).

There is disclosed a configuration of a toner regulatory blade having a tip end thereof once bent so that a predetermined divergence is formed between the blade tip end, which comes into contact with a developing roller in a direction against rotation of the developing roller, that is, a direction opposed to a direction, in which a surface of the developing roller moves, and the developing roller (see, for example, JP-A-11-167278).

There is disclosed a configuration of a toner regulatory blade, in which a portion having an arcuate-shaped cross section is formed integrally at a tip end of the blade in contact with a developing roller in a direction against rotation of the developing roller (see, for example, JP-A-2-135470).

In the tandem system disclosed in JP-A-2001-356548, a pitch of photosensitive bodies is approximately 2.4 times a diameter of the photo-sensitive bodies. In the case where such pitch of photosensitive bodies is reduced to at most 2 times the photosensitive-body diameter, image forming means arranged vertically interfere with one another, and therefore a limit is placed on miniaturization of an area around the photosensitive bodies.

In the example disclosed in JP-A-2001-296713, exposure means are fixedly mounted centrally of a body of an electrophotographic apparatus and light beams from the exposure means are irradiated on photosensitive bodies through spaces formed between charging means, developing means, cleaner means, and so on, which can be attachably and detachably mounted to the bodies, so that a whole image forming apparatus becomes large in size and a limit is placed on miniaturization of image forming means.

No configuration suited to miniaturization of whole developing means is disclosed in the examples of JP-A-5-11584 and JP-A-11-344858.

In the system disclosed in JP-A-11-167278, in which a tip end of a toner regulatory blade is brought into contact with a developing roller in a direction against rotation of the developing roller, a fixing member for fixation of the tip end of the regulatory blade is in most cases arranged above the developing roller. When the spring is lengthened so as to decrease a spring constant of the regulatory blade to reduce dispersion in pressing forces, a larger space above the developing roller is needed, and so developing means must be thickened, thus making miniaturization of image forming means impossible.

In the system disclosed in JP-A-2-135470, in which a tip end of a toner regulatory blade having an arcuate-shaped cross section is brought into contact with a developing roller in a direction against rotation thereof, such system is of the "against" system and not suited to miniaturization of a developing means. Also, in the case where a toner regulatory blade having an arcuate-shaped cross section at a tip end thereof is diverted to a system involving contact in a direction following rotation of a developing roller and arranged substantially horizontally, there are generated a toner filming phenomenon, in which regulated toner accumulates between the toner regulatory blade and the developing roller to adhere to the regulatory blade or the developing roller, and a phenomenon, in which insufficiency of toner regulating forces causes an increase in a passing toner and insufficiency of electrification of toner.

BRIEF SUMMARY OF THE INVENTION

Hereupon, it is an object of the invention to provide a small-sized electrophotographic apparatus with a decreased interval, at which photosensitive drums are mounted.

It is another object of the invention to provide a small-sized electrophotographic apparatus provided with toner regulatory blades, which are free from a toner filming phenomenon, an increase in a passing toner, and insufficiency of electrification of toner due to insufficiency of toner regulating forces.

To attain the above object, the invention provides an electrophotographic apparatus comprising a plurality of image forming means comprising a photosensitive drum provided on a surface thereof with a photosensitive layer, charging means for having the photosensitive layer charged at a predetermined electric potential, exposure means for subjecting the photosensitive layer to exposure on the basis of image data to form an electrostatic latent image, and developing means for adhering toner to the electro-static latent image on the photosensitive drum to form a toner image, and wherein the plurality of image forming means are arranged in contact with the photosensitive drums with an outer peripheral surface of a straight portion of an endless intermediate transfer belt, which is stretched around a drive roller and a driven roller to revolve, or of a medium conveyance belt, and overlap one another along the straight portion to transfer toner images formed on the plurality of photosensitive drums, through the intermediate transfer belt, or directly to a medium to form a color image, and the developing means comprises: a tip end part of a developing means comprising a developing roller in contact with the photosensitive drum to rotate to form a thin toner layer on a surface of the photosensitive drum, a supplying roller for supplying toner to the developing roller, and a toner regulatory blade to come into linear contact with an outer peripheral surface of the developing roller at a predetermined pressure to form a thin toner layer on the surface of the photosensitive drum; and a toner storage part coupled to the tip end part of the developing means to store toner, and wherein a thickness of the tip end part of the developing means in a direction of movement of the intermediate transfer belt, or the medium conveyance belt is smaller than a thickness of the toner storage part in the direction of movement, and the exposure means is arranged in a location, in which the tip end part of the developing means is small in thickness.

To attain the another object, the invention provides an electrophotographic apparatus comprising a plurality of image forming means comprising a photosensitive drum provided on a surface thereof with a photosensitive layer, charging means for having the photosensitive layer charged at a predetermined electric potential, exposure means for subjecting the photosensitive layer to exposure on the basis of image data to form an electrostatic latent image, and developing means for adhering toner to the electrostatic latent image on the photosensitive drum to form a toner image, and wherein the plurality of image forming means are arranged in contact with the photosensitive drums with an outer peripheral surface of a straight portion of an endless intermediate transfer belt, which is stretched around a drive roller and a driven roller to revolve, or a medium conveyance belt, and overlap one another along the straight portion to transfer toner images formed on the plurality of photosensitive drums, through the intermediate transfer belt, or directly to a medium to form a color image, and the developing means comprises: a tip end part of a developing means comprising a developing roller in contact with the photosensitive drum to rotate to form a thin toner layer on a surface of the photosensitive drum, a supplying roller for supplying toner to the developing roller, and a toner regulatory blade to come into linear contact with an outer peripheral surface of the developing roller at a predetermined pressure to form a thin toner layer on the surface of the photosensitive drum; and a toner storage part coupled to the tip end part of the developing means to store toner, and wherein the toner regulatory blade extends in a direction along a normal to the straight portion of the intermediate transfer belt, or of the medium conveyance belt and arranged to come into contact with the developing roller from a direction following rotation of the developing roller, the toner regulatory blade has a cross sectional shape of symbol √, and a contact portion of the toner regulatory blade and the developing roller is in contact with each other in a position of about 10° to 60° relative to an axis of the developing roller in an upstream direction of rotation of the developing roller.

Other objects, features and advantages of the invention will become apparent from the following description of the embodiments of the invention taken in conjunction with the accompanying drawings.

DETAILED DESCRIPTION OF THE INVENTION

Figure 1:
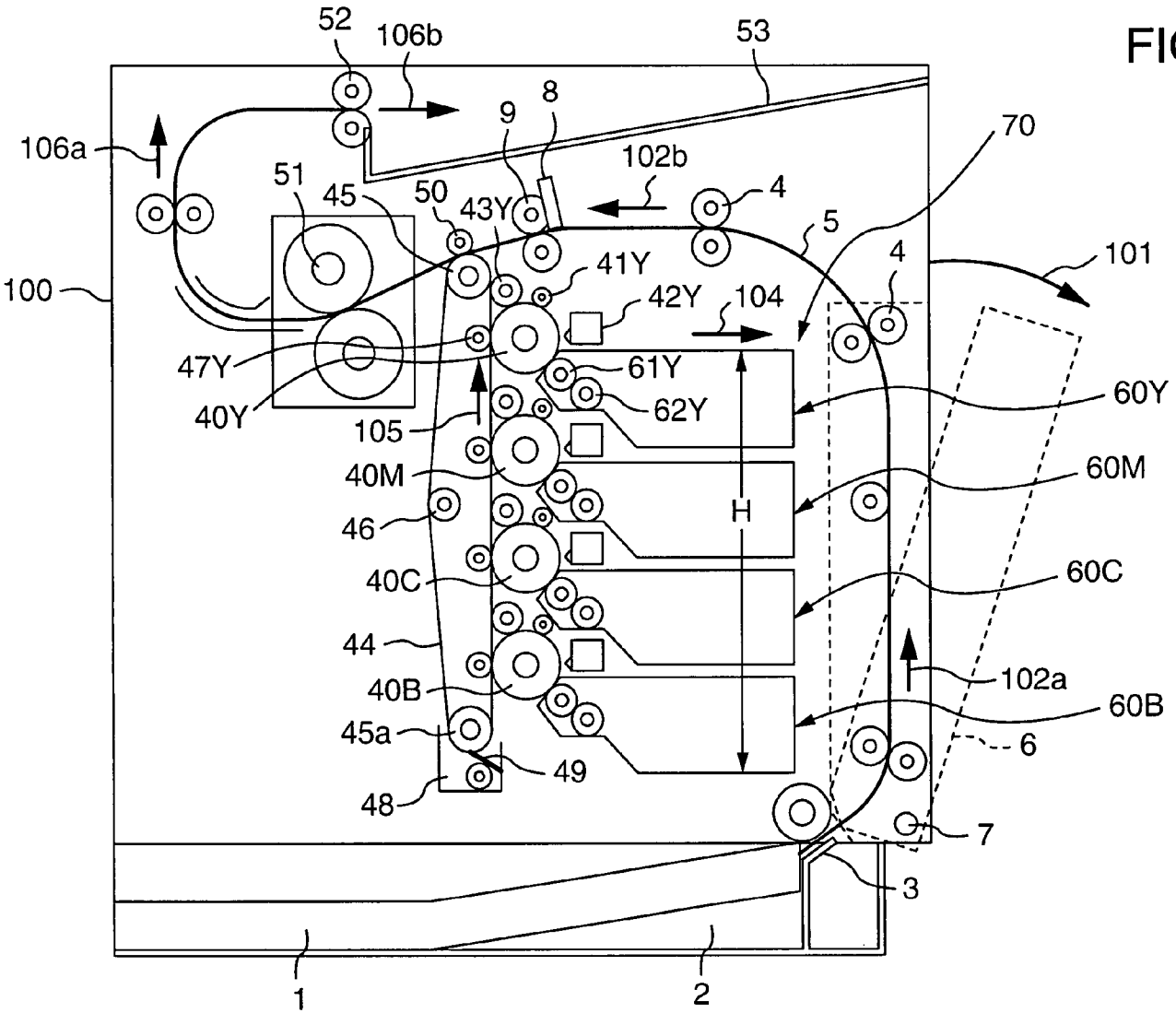
FIG. 1 is a cross sectional view showing a whole constitution of a first embodiment of an electrophotographic apparatus according to the invention.

In order to realize a small pitch mounting, it is necessary to miniaturize photosensitive drums, charging means, developing means, exposure means, developing means, and transfer means, respectively, which constitute image forming means.

As the charging means, a roller charging system using a conductive rubber roller, a brush charging system using a brush made of conductive felt fiber, and so on, may be made use of in place of Scorotron electrifiers having been frequently used.

As the exposure means, for example, measures making use of a LED array, in which light emitting diodes are arranged in a line in a scanning direction, to disuse mechanical moving parts to achieve miniaturization can be used in place of laser exposure means for performing scanning in a sub-scanning direction (a widthwise direction of a sheet) by means of a polygonal mirror for rotation of laser light.

Since charging means, exposure means, developing means, transfer means, and cleaner means must be arranged in this order along a surface of a photosensitive body, it is essential that a portion of developing means in the neighborhood of the photosensitive body be thinned in order to miniaturize the photosensitive body and decrease a pitch of photosensitive bodies.

Shape and positional relationship to eliminate interference between adjacent image forming means enable mounting at high density and miniaturization of image forming means, which form four color toner images, and miniaturization of a tandem type printer.

Meanwhile, it is desired that developing means be made as large as possible in volume to serve as a toner container so as to reduce frequency, at which a user exchanges toners.

Accordingly, a tradeoff demand is made to achieve miniaturization/thinning around portions in contact with a photosensitive body and to increase a volume of a toner container.

Also, with an electrophotographic apparatus, to which the invention relates, an electrostatic latent image formed on a surface of a photosensitive drum by exposure means is developed by a developing roller arranged at a tip end of developing means, and therefore exposure means is arranged adjacently in a direction of movement of an intermediate transfer belt of the developing means, or a sheet conveyance belt. As a result of the exposure means and the developing means being arranged adjacently in the belt moving direction, a stacking pitch of image forming means depends upon a stacking pitch of the exposure means and the developing means.

The developing means comprises a tip end part of a developing means, on which a developing roller, a supplying roller, and a toner regulatory blade are mounted, and a toner storage part connected to the tip end part to store toner therein. The tip end part of the developing means is adjacent to the exposure means. A stacking pitch of image forming means depends upon a stacking pitch of the exposure means and the tip end part of the developing means.

Paying attention to the above, the inventors of the present application have contrived to make a thickness of a tip end part of a developing means in a direction of belt movement smaller than a thickness of a toner storage part and to arrange exposure means adjacent to the thinned tip end part of the developing means to decrease a stacking pitch of image forming means as a whole.

As a measure for reducing a thickness of a tip end part of a developing means, a toner regulatory blade mounted on the tip end part of the developing means is arranged such that a cross section of the blade taken along a plane perpendicular to an axis of a developing roller is arranged in a direction along a normal to an intermediate transfer belt or a sheet conveyance belt and that the blade come into contact with the developing roller from an upstream side of rotation of the developing roller.

When the toner regulatory blade is arranged in this manner, a length of the toner regulatory blade has no influence on a thickness of the tip end part of the developing means, and so the thickness of the tip end part of the developing means can be made small.

Also, the toner regulatory blade is subjected to bending at least once in an integral forming operation whereby a space, in which toner as regulated is efficiently circulated, is ensured and a tip end of the toner regulatory blade is evenly brought into contact with a developing roller to enable stably forming a thin toner layer required for development over a long term.

As a result, a stacking pitch of image forming means, that is, the sum of a thickness of the tip end part of the developing means and a thickness of exposure means in a direction of movement of an intermediate transfer belt, or a sheet conveyance belt, inclusive of a necessary gap between the both, can be made 1.6 to 2 times a diameter of a photosensitive drum.

When a thickness of a toner storage part in a direction of movement of an intermediate transfer belt, or a sheet conveyance belt is made approximately equal to a pith, at which a plurality of image forming means are arranged, it is possible to ensure a sufficient toner storage volume.

In addition, the image forming means, or exposure means and charging means of that image forming means, which is arranged adjacent to the developing means to use a color toner of a different color, may be arranged in a stepped space defined by the toner storage part and the thinned tip end part of the developing means.

Subsequently, embodiments of an electrophotographic apparatus according to the invention will be described with reference to FIGS. 1 to 13.

FIG. 1 is a cross sectional view showing a whole constitution of a first embodiment of an electrophotographic apparatus according to the invention.

The electrophotographic apparatus of the first embodiment comprises a casing 100, a sheet cassette 2, sheet separation means 3, conveyance means 4, a sheet conveyance path 5, an opening and closing door 6, sheet position detection means 8, registration rollers 9, four sets of image forming means 70 for yellow Y, magenta M, cyan C, and black B, an intermediate transfer belt 44, a drive roller 45, a driven roller 45*a*, a tension regulatory roller 46, transfer cleaning means 48, a second transfer roller 50, a fixing device 51, a pair of sheet ejection rollers 52, and a sheet ejection tray 53.

The sheet cassette 2 is arranged on a bottom of the casing 100 to be drawable toward a front surface side and to store therein sheets 1. The sheet separation means 3 is mounted on an end of the sheet cassette 2 near the opening and closing door 6 to separate a plurality of print sheets 1 set in the sheet cassette 2 sheet by sheet.

The conveyance means 4 is made of rubber rollers to convey sheets 1, having been separated sheet by sheet, at a predetermined speed along the conveyance path 5 provided with sheet conveyance guides in a direction indicated by an arrow 102*a*, 102*b*. The sheet conveyance path 5 begins at a point of contact of the sheet separation means 3 and the sheet cassette 2 to be extended to the sheet ejection rollers 52 via the drive roller 45 and the second transfer roller 50.

The opening and closing door 6 is arranged on a front surface of the casing 100 to be opened about a pivot 7 in a direction indicated by an arrow 101.

The sheet position detection means 8 is arranged in the sheet conveyance path 5 upstream of the registration rollers 9 to detect a position of a sheet. The sheet position detection means 8 adopts one of a reflected light detection system for detecting a change in quantity of reflected light from a surface of a sheet 1, a transmitted light detection system for detecting a change in quantity of received light when a sheet 1 passes between an emitter and a receiver, and a lever detection system for detecting a sheet 1 contacting with a lever, and the like, and thus detects arrival of a tip end of a sheet 1 at the sheet position detection means 8 to output a sheet position signal.

The pair of registration rollers 9 are arranged in the sheet conveyance path 5 on a side of the second transfer roller 50 near the sheet separation means 3 to be disposed adjacent to the second transfer roller 50.

The image forming means 70 for yellow Y, magenta M, cyan C, and black B are stacked vertically downwardly in this order along a side of the intermediate transfer belt 44 near the opening and closing door 6.

The endless intermediate transfer belt 44 is trained around the drive roller 45 and the driven roller 45*a* in an annular manner. The drive roller 45 is arranged in a central and upper portion of the casing 100 with an axis thereof parallel to an axis of the pivot 7. The driven roller 45*a* is arranged below the drive roller 45 with an axis thereof parallel to the axis of the drive roller 45. The tension regulatory roller 46 is in contact with an inside of the intermediate transfer belt 44 on a side of the intermediate transfer belt 44 far from the opening and closing door 6.

The transfer cleaning means 48 is opposed to the driven roller 45*a* with the intermediate transfer belt 44 therebetween. The transfer cleaning means 48 is provided with a cleaning blade 49, which is arranged with an end thereof in contact with an outer peripheral surface of the intermediate transfer belt 44 at a predetermined pressure to scrape off toner remaining on the outer peripheral surface. Toner having been scraped off is collected in a container of the transfer cleaning means 48.

In addition, while the first embodiment uses the cleaning blade 49 in order to scrape off toner remaining on the outer peripheral surface of the intermediate transfer belt 44, a cleaning roller may be used.

The second transfer roller 50 is arranged with an axis thereof parallel to the drive roller 45 and with an outer peripheral surface thereof in contact with an outer peripheral surface of the drive roller 45. A sheet 1 having been conveyed in the sheet conveyance path 5 in a direction indicated by the arrow 102*a*, 102*b* is brought into contact with the intermediate transfer belt 44, and thus a toner image formed on the intermediate transfer belt 44 is transferred to a surface of the sheet 1.

The fixing device 51 is mounted in the sheet conveyance path 5 on a side of the second transfer roller 50 near the sheet ejection tray 53. The fixing device 51 is provided therein with heating means, such as nichrome wire, halogen lamp, or the like, to raise temperature up to a temperature, at which toner on the sheet 1 melts, and to apply a predetermined pressure to fix the melted toner to the sheet. Curved surface guides to interpose a sheet therebetween are provided on a sheet ejection side of the fixing device 51 to move a sheet along the sheet conveyance path 5.

The pair of sheet ejection rollers 52 are arranged on a side of the sheet ejection tray 53 far from the opening and closing door 6 with an axis thereof parallel to the axis of the pivot 7 and with outer peripheral surfaces thereof in contact with each other. The sheet ejection rollers 52 eject the sheet 1 having been conveyed, to an outside.

The sheet ejection tray 53 in an upper portion of the casing 100 holds sheets 1 ejected outside of the apparatus from the sheet ejection rollers 52.

Figure 2:
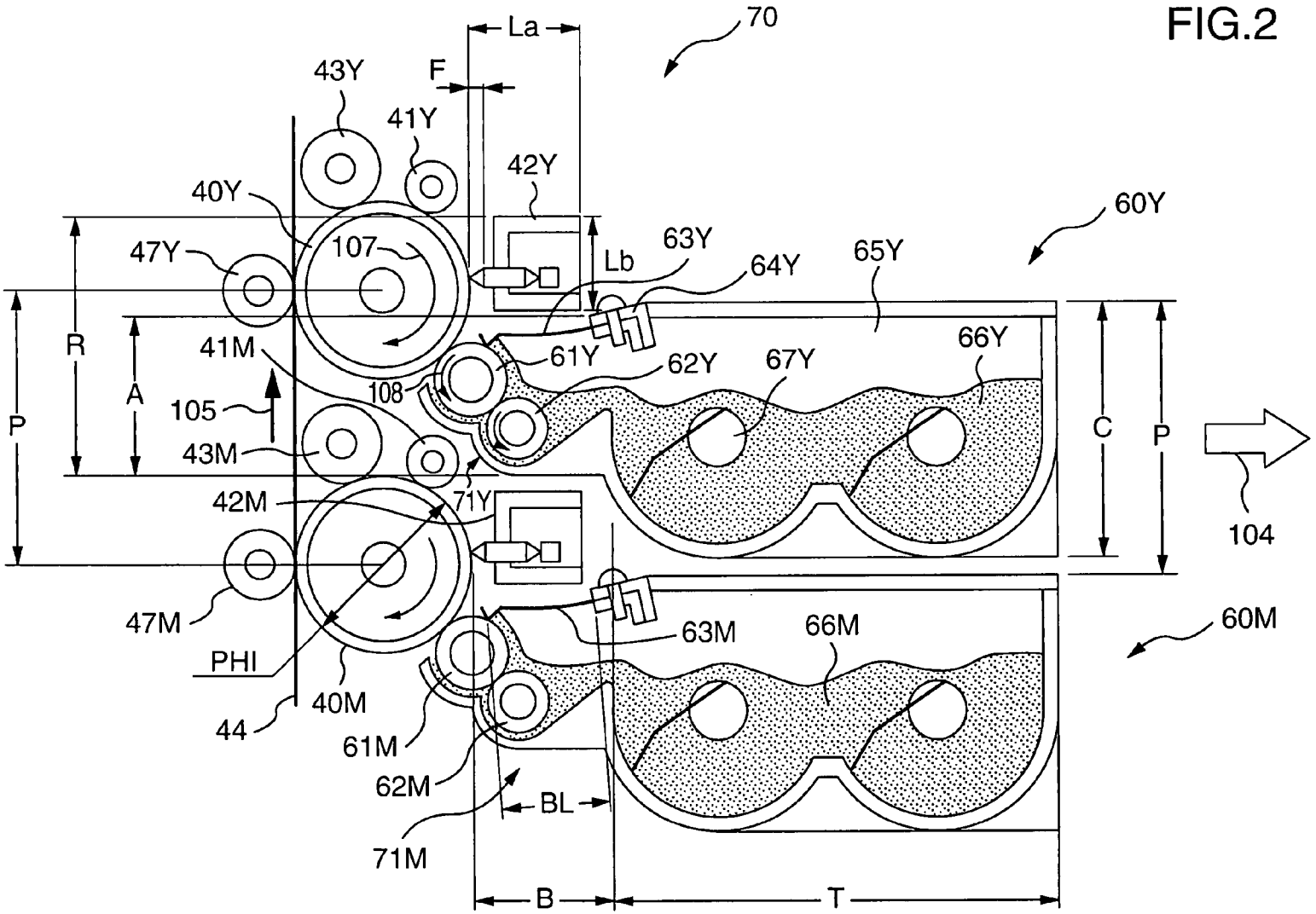
FIG. 2 is a cross sectional view showing a constitution of an essential part of the first embodiment.

FIG. 2 is a cross sectional view showing a constitution of an essential part of the first embodiment.

While four sets of image forming means 70 are required for obtaining a color image, only two sets of image forming means for yellow Y and magenta M are shown in FIG. 2. Since four sets of image forming means 70 corresponding to yellow Y, magenta M, cyan C, and black B are of the same constitution, a constitution of the image forming means 70 for yellow will be described.

The image forming means 70 for yellow comprises a photosensitive drum 40Y, charging means 41Y, exposure means 42Y, developing means 60Y, cleaner means 43Y, and a first transfer roller 47Y.

The photosensitive drum 40Y comprises a cylinder, a surface of which is coated with, for example, selenium and a photosensitive, thin organic film, to form an electrostatic latent image and a toner image. The photosensitive drum 40Y rotates with an axis thereof parallel to the axis of the drive roller 45 and with an outer peripheral surface thereof in contact with an outer peripheral surface of the intermediate transfer belt 44 near the opening and closing door 6.

The charging means 41Y comprises, for example, a conductive rubber roller to apply voltage of around 1 kV to 2 kV to electrify the surface of the photosensitive drum 40Y at a predetermined voltage.

The exposure means 42Y comprises a LED array arranged in a line in a widthwise direction of a photosensitive body, and is arranged a predetermined focal distance F apart from the surface of the photosensitive drum 40Y on a downstream side of the cleaner means 43Y in a direction 107 of rotation of the photosensitive drum 40Y with a direction of irradiation directed toward the outer peripheral surface of the photosensitive drum 40Y. The LED array comprises, for example, 600 to 1200 LEDs per 1 inch (25.4 mm) to form an electrostatic latent image on the outer peripheral surface of the photosensitive drum 40Y.

The cleaner means 43Y is arranged on a downstream side of the first transfer roller 47Y in the direction of rotation of the photosensitive drum 40Y with an axis thereof parallel to the axis of the photosensitive drum 40Y and with outer peripheral surfaces thereof in contact with each other.

The developing means 60Y stores a yellow toner 66Y and is mounted on a downstream side of the exposure means 42Y in the direction 107 of rotation of the photosensitive drum 40Y and comprises a developing roller 61Y mounted in parallel to the photosensitive drum 40Y with its outer peripheral surface in contact with the outer peripheral surface of the photosensitive drum 40Y The developing means 60Y can be easily taken out and remounted linearly in a direction indicated by an arrow 104 with the opening and closing door 6 opened in FIG. 1.

The developing roller 61Y comprises a core made of metal such as stainless steel or the like, and is provided on a surface thereof with a conductive, elastic film, such as polyurethane rubber, silicone rubber, or the like, to which carbon is added to provide for conductivity of around $10^3$ to $10^9$ Ω·cm. A surface of the developing roller 61Y rotates in a direction indicated by an arrow 108.

The developing means 60Y comprises a supplying roller 62Y mounted in parallel to the developing roller 61Y, and an outer peripheral surface of the supplying roller 62Y is in contact with the outer peripheral surface of the developing roller 61Y.

The supplying roller 62Y has a surface thereof made of, for example, porous sponge rubber, and is in contact with the developing roller 61Y to rotate in the same direction as that of the developing roller to feed toner to the developing roller 61Y.

A toner regulatory blade 63Y comprises a leaf spring, a stationary end of which is fixed to a housing of the developing means 60Y and a free end of which is brought into linear contact with the developing roller 61Y along a generating line of the developing roller 61Y. The free end of the toner regulatory blade 63Y is in contact with the outer peripheral surface of the developing roller 61Y at a predetermined pressure to slide on the surface as the developing roller 61Y rotates, thus charging toner with electricity and forming a thin toner layer of a predetermined thickness on the surface of the developing roller 61Y.

The toner regulatory blade 63Y is arranged such that a straight line connecting between the stationary end and a contact point on the developing roller 61Y in a cross section taken along a plane perpendicular to the axis of the developing roller 61 runs along a normal to the surface of the intermediate transfer belt 44.

It is ideal that the straight line is perpendicular to the surface of the intermediate transfer belt 44, and it is desired that an angle formed between the straight line and the normal to the surface of the intermediate transfer belt 44 be 10 degrees or less. The smaller the angle, the smaller a dimension occupied by the toner regulatory blade 63 in a direction, in which the image forming means 70 are stacked, so that a pitch, at which the image forming means 70 are stacked, can be decreased.

The developing means 60Y comprises a toner storage part 65Y for storing a yellow-toner 66Y, and a tip end part 71Y in which the developing roller 61Y and the supplying roller 62Y are provided and which has the toner regulatory blade 63Y.

A first transfer roller 47Y is mounted in parallel to the photosensitive drum 40Y and is in contact with the photosensitive drum 40Y with the intermediate transfer belt 44 therebetween.

The cleaner means 43Y according to the first embodiment comprises a brush roller having a core made of metal such as stainless steel or the like, and having, for example, conductive fibers planted on a surface thereof, the roller is in contact with the outer peripheral surface of the photosensitive drum 40Y to remove toner not having been transferred to the intermediate transfer belt 44 and remaining on the photosensitive drum 40Y.

In the first embodiment, four sets of image forming means 70 making use of color toners of black B, magenta M, cyan C, and yellow Y to perform full color printing are stacked vertically along the intermediate transfer belt 44.

The endless intermediate transfer belt 44 is made of a conductive material such as polyimide, polycarbonate, or the like and arranged lengthily in a vertical direction. The intermediate transfer belt 44 is trained around the drive roller 45, the driven roller 45*a* arranged below the drive roller 45, and the tension regulatory roller 46, and acted by an appropriate tension from the tension regulatory roller 46 so as not to loosen.

That side of the intermediate transfer belt 44, which is in contact with the photosensitive drums 40Y, M, C, B, moves at a predetermined speed in a direction indicated by an arrow 105 as the drive roller 45 rotates. One side of the intermediate transfer belt 44 is in contact with four sets of photosensitive drums 40 for forming color toner images of black B, magenta M, cyan C, and yellow Y.

The first transfer rollers 47 applied with a predetermined voltage are arranged on a side of the intermediate transfer belt 44 opposed the respective photosensitive drums 40 to face respective color photosensitive drums 40B, 40C, 40M, 40Y, and are in contact with the respective photosensitive drums 40 with the intermediate transfer belt 44 therebetween.

Subsequently, an explanation will be given to the procedure of forming color images on a sheet in the electrophotographic apparatus of the first embodiment. The four sets of image forming means 70 form color toner images of black B, magenta M, cyan C, and yellow Y. Here, an explanation will be given to the case where an image of yellow Y is formed. Images of black B, magenta M, and cyan C are formed in the same procedure.

When a predetermined voltage is applied to a charging roller 41Y, a photosensitive layer on the surface of the photosensitive drum 40Y is uniformly charged with electricity.

LED light corresponding to a yellow image is irradiated on the photosensitive drum 40Y from the exposure means 42Y, and the photosensitive layer is subjected to exposure. That portion of the photo-sensitive layer on the surface of the photosensitive drum 40Y, which is subjected to exposure, approaches a ground level in charged potential, so that an unseen electrostatic latent image is formed on the photosensitive layer.

Toner in a thin, yellow toner layer formed on the surface of the developing roller 61Y is caused to adhere to the electrostatic latent image on the photosensitive drum 40Y to develop a toner image.

The yellow toner image formed in this manner is transferred to the surface of the intermediate transfer belt 44.

Toner not having been transferred to the intermediate transfer belt 44 and remaining on the photosensitive drum 40Y is removed by the cleaner means 43Y.

The image forming means 70 corresponding to respective colors of black B, magenta M, and cyan C form color toner images therefor to transfer the same to the intermediate transfer belt 44.

Toner images on the respective color photosensitive drums 40B, 40M, 40C, and 40Y are formed with an appropriate time difference in accordance with a moving speed of the intermediate transfer belt 44 and spacings of the respective photosensitive drums 40 in a direction of movement of the intermediate transfer belt 44. These toner images are superposed on one another when transferred onto the intermediate transfer belt 44, and a full color toner image is formed on the intermediate transfer belt 44.

Subsequently, the full color toner image formed on the intermediate transfer belt 44 is transferred to a sheet 1.

Sheets 1 set in the sheet cassette 2 are separated sheet by sheet by the sheet separation means 3 to be forwarded to the sheet conveyance path 5. A sheet 1 is interposed between the pair of rotatable conveyance means 4 facing each other. At least one of the conveyance means 4 comprises a drive roller to move a sheet 1 at a predetermined speed in a desired direction.

A sheet 1 is moved along arrows 102*a*, 102*b* in the sheet conveyance path 5. When the sheet position detection means 8 detects a tip end of the sheet 1, the registration rollers 9 for sheet positioning are once stopped. When rotation of the conveyance means 4 is continued in this state, the tip end of the sheet 1 is pushed against a nip portion of the registration rollers 9, that is, a contact area of the rollers, to be made in parallel to axes of the registration rollers 9.

The registration rollers 9 are driven again in such a timing that the tip end of the sheet 1 and a tip end position of a toner image formed on the intermediate transfer belt 44 are put in a predetermined positional relationship. The second transfer roller 50 brings a surface of the sheet into contact with the intermediate transfer belt 44 to transfer the toner image on the intermediate transfer belt 44 to the sheet 1.

The sheet 1 is fed to the fixing device 51 to allow the transferred toner image to be fixed to a surface thereof.

The sheet 1, to a surface of which toner has adhered, is heated to a temperature, at which toner melts, by the fixing device 51. Since a surface of the fixing device 51 is at a temperature in the order of 160° C. and toner on the sheet 1 has a melting temperature of around 100° C., toner melts in a short time when passing through the fixing device 51.

In the fixing device 51, pressure between the rollers of the fixing device 51, or between the roller and the belt presses molten toner against the sheet 1 to adhere the toner to the sheet, and the molten toner then undergoes natural cooling.

The sheet 1 having undergone fixing is conveyed in the sheet conveyance path 5 in a direction indicated by arrows 106*a*, 106*b* to be ejected into the sheet ejection tray 53 by the sheet ejection rollers 52.

When the above series of operations are repeated, sheets, on which color images are fixed, are successively obtained.

The toner regulatory blade 63 comprises a metallic leaf spring secured to toner regulatory blade mount means 64 of the toner storage part 65 by screws or the like to extend substantially perpendicular to the vertically stretched intermediate transfer belt 44, that is, substantially horizontally.

A tip end of the toner regulatory blade 63 is in contact with a neighborhood of a top of an upper surface of the developing roller 61 at a predetermined pressure to regulate a thickness of toner adhered to the surface of the developing roller 61 to form a thin layer of a predetermined quantity of toner charged with a predetermined electric charge.

That portion of the toner regulatory blade 63, which is in contact with the outer peripheral surface of the developing roller 61 close to the top of the upper surface of the developing roller 61, is not limited to an actual end of the toner regulatory blade 63. That is, the contact portion may be a corner or a bend formed by bending the toner regulatory blade 63.

The toner regulatory blade 63 is arranged in such a positional relationship and structure as to generate a predetermined flexural amount when comes into contact with the outer peripheral surface of the developing roller 61, and to come into contact with the developing roller 61 in a direction following the rotation.

The toner storage part 65 comprises toner agitating means 67 for agitating and supplying toner to the developing roller 61 from the supplying roller 62.

The developing means 60, in which toner 66 is exhausted, can be taken out substantially linearly as a whole in the direction indicated by the arrow 104, and a new developing means 60 can be remounted.

In the first embodiment, since the toner regulatory blade 63 is arranged in a direction following the rotation of the roller and substantially horizontally, it suffices that a position of the toner regulatory blade mount means 64 be shifted rightward so as to lengthen a length BL of the toner regulatory blade 63 for the purpose of reducing a spring constant to decrease that dispersion in a pressing force on the developing roller 61, which is possibly generated by dispersion in dimension or the like.

Since a decrease in dispersion of a pressing force applied on the developing roller 61 by the toner regulatory blade 63 can be realized without an increase in a thickness A of the tip end part 71 of the developing means, the above constitution is effective in thinning a neighborhood of the developing roller 61 of the developing means 60.

As described previously, the image forming means 70 comprising the photosensitive drum 40, the charging means 41, the exposure means 42, the developing means 60, and the cleaner means 43 must be mounted in high density in order to decrease a dimension of the whole apparatus. More specifically, a photosensitive body pitch between one and another of the plurality of photosensitive drums 40 must be made as small as possible, and the photosensitive drum 40, the charging means 41, the exposure means 42, the developing means 60, and the cleaner means 43, which constitute the image forming means 70, must be arranged not to interfere with one another.

Meanwhile, even when a concerned apparatus is small-sized, an amount of toner 66 filled in the toner storage part 65 is desirably as much as possible.

In order to make the image forming apparatus small in size, pitch, or spacing, when the image forming means 70 corresponding to respective color toners are stacked on one another, must be made as small as possible.

Here, when the photosensitive drums 40 have a diameter of, for example, ϕ30 mm and a stacking pitch P, the pitch of the photosensitive drums 40 and a stacking pitch of the developing means 60 will become P.

Also, the tip end part 71 of the developing means in the vicinity of the developing roller 61 and the exposure means 42 overlap each other in a heightwise direction.

Accordingly, a thickness A of the tip end part of the developing means must be thinned to meet $A<P-Lb$ where Lb indicates a dimension of the exposure means 42 in a direction of emission, La indicates a height of the exposure means in a direction perpendicular to the direction of emission, and A indicates a dimension of the tip end part 71 of the developing means, which is near the photosensitive drum 40 and in which the developing roller and the supplying roller are mounted, in a heightwise direction.

For example, it is assumed that the dimension A is 25 mm and a distance from the photosensitive drum 40 to an end of the tip end part of the developing means, which has the dimension A in the heightwise direction, far from the photosensitive drum 40 is B.

In order that the exposure means 42 and the tip end part 71 of the developing means overlap each other without an idle space, the exposure means 42 must be installed between the end of the tip end part of the developing means, which has the dimension A in the heightwise direction, far from the photosensitive drum 40 and the photosensitive drum 40. That is, the dimension B from the surface of the photosensitive drum 40 to an end of the tip end part of the developing means toward the opening and closing door should meet $B>Lb$ as compared with the dimension Lb of the exposure means 42.

Meanwhile, when the dimension B is excessive, a spacing between the toner storage part 65 and the developing roller 61, the supplying roller 62 becomes large, so that even when toner 66 stored in the toner storage part 65 is agitated by the toner agitating means 67, it is not adequately supplied to the supplying roller 62.

Further, since a toner volume of the toner storage part 65 is substantially represented by the product $T\times C$ of a length T and a height C of the toner storage part 65, it is not desirable to decrease the length T when it is aimed at increasing the toner volume as much as possible. Hereupon, when the dimension B is increased, a whole length (T+B) of the developing means 60 is lengthened, so that miniaturization is not possible.

Also, when toner adheres to a tip end of the LED array in the exposure means 42, fault in exposure results to generate white streaks on an image to deteriorate the image. Accordingly, the LED array in the exposure means 42 is desirably arranged with an optical axis horizontal, or facing downward rather than horizontally.

In the first embodiment shown in FIG. 2, the LED array is arranged such that an optical axis faces downward at about 3° to 5° relative to the horizon. In addition, the angle of the optical axis is not limited to that in the embodiment shown in FIG. 2 but may be further inclined within, for example, that scope, in which interference with the developing means is obviated.

Figure 3:
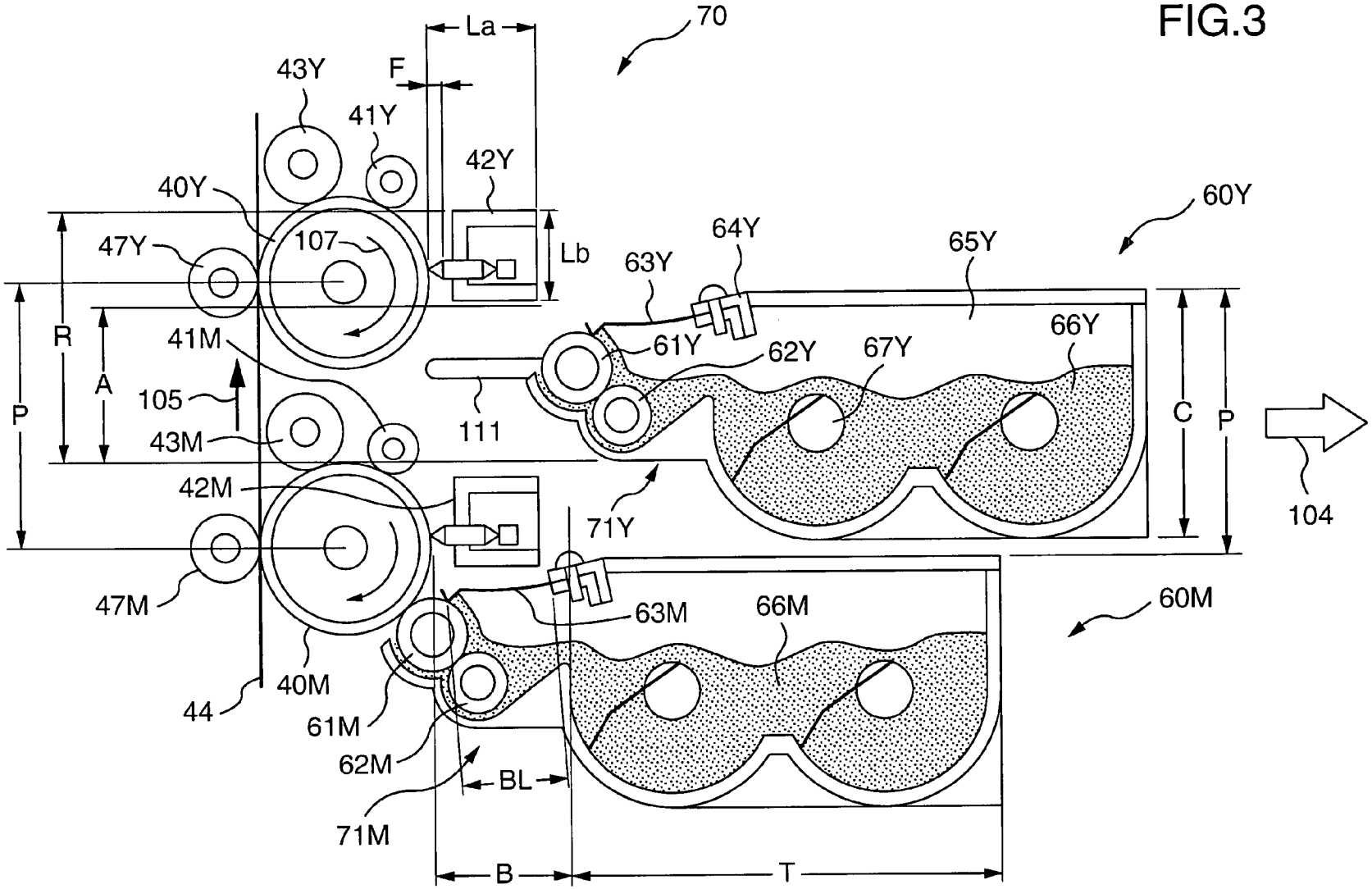
FIG. 3 is a cross sectional view showing a state, in which a single developing means in the essential part of the first embodiment is taken out.

FIG. 3 is a cross sectional view showing a state, in which a single developing means 60Y in the essential part of the first embodiment is taken out in the direction indicated by the arrow 104. Shaft end portions of the developing roller 61Y are guided in guide grooves 111 to be movable left and right, and can be taken out linearly rightward.

Since the tip end part 71 of the developing means is formed to be sized not to interfere with the exposure means 42Y, 42M, it can be taken out linearly when toner 66 is exhausted and the developing means 60Y or 60M is to be taken out.

Generally, since taking-out/insertion in a linear manner is an easiest operation, a work, in which a user exchanges the developing means 60 upon exhaustion of toner, is facilitated and the electrophotographic apparatus becomes convenient in use.

In addition, the sheet conveyance path 5 is arranged on a right side of the developing means 60Y, 60M, 60C, 60B as shown in FIG. 1, and a plurality of conveyance means 4 appear to constitute an obstacle in the case where the developing means 60 is taken out in the direction indicated by the arrow 104.

However, no hindrance is caused since these conveyance means 4 are mounted inside the opening and closing door 6 and the opening and closing door 6 is opened close to a horizontal position when the developing means 60 is taken out in the direction indicated by the arrow.

According to the first embodiment, the toner regulatory blades 63Y, 63M are arranged substantially horizontally as shown in FIG. 2, the developing roller 61 and the supplying roller 62 are arranged, a bottom surface of the tip end part 71 of the developing means is stepped relative to a bottom surface of the toner storage part 65 to thin the tip end part 71 of the developing means, and the exposure means 42 is arranged in a space defined by thinning the tip end part 71 of the developing means, so that a pitch P of the photosensitive drums 40, that is, a pitch P of the image forming means 70 can be decreased. More concretely, high-density mounting is made possible, in which the pitch P of arrangement of the image forming means 70 is made 1.5 to 2 times a diameter of the photosensitive drums 40.

Also, since the height C of the toner storage part 65 can be increased to a value substantially equal to the pitch P of the photosensitive drums 40, for example, around (P−2) mm, an amount of toner 66 as stored is increased while thinning of the tip end part 71 of the developing means is realized, and thus small-sizing and high-density mounting of a tandem-type image forming apparatus can be realized.

An explanation will be given to a pitch P of photosensitive drums in the case where a tip end part of a developing means is not tapered. For example, it is assumed that photosensitive drums 40 have a diameter of 30 mm, which is generally adopted, developing means 60 have a thickness C of 40 mm, and exposure means 42 have a thickness of 15 mm.

Assuming that the thickness of 15 mm of the exposure means 42 is added to a thickness of 40 mm of a developing means 60 to make 55 mm and that gaps of 3 mm are provided above and below the developing means 60 and the exposure means 42 to eliminate contact therebetween, a total thickness makes 61 mm and the pitch P of the photosensitive drums amounts to at least 2 times the diameter of the photosensitive drums.

In contrast, when the tip end part 71 of the developing means in the invention is tapered up to a thickness of, for example, 25 mm, thickness of the tip end part 71 of the developing means and the exposure means 42 are summed to make 40 mm, and further even when gaps of 3 mm are provided above and below the developing mans 60 and the exposure means 42 to eliminate contact therebetween, the pitch P of the photosensitive drums can be decreased to 46 mm, that is, at most 2 times the diameter of 30 mm of the photosensitive drums 40, so that small-sizing and high-density mounting of an image forming apparatus for tandem-type color printers can be realized.

Figure 4:
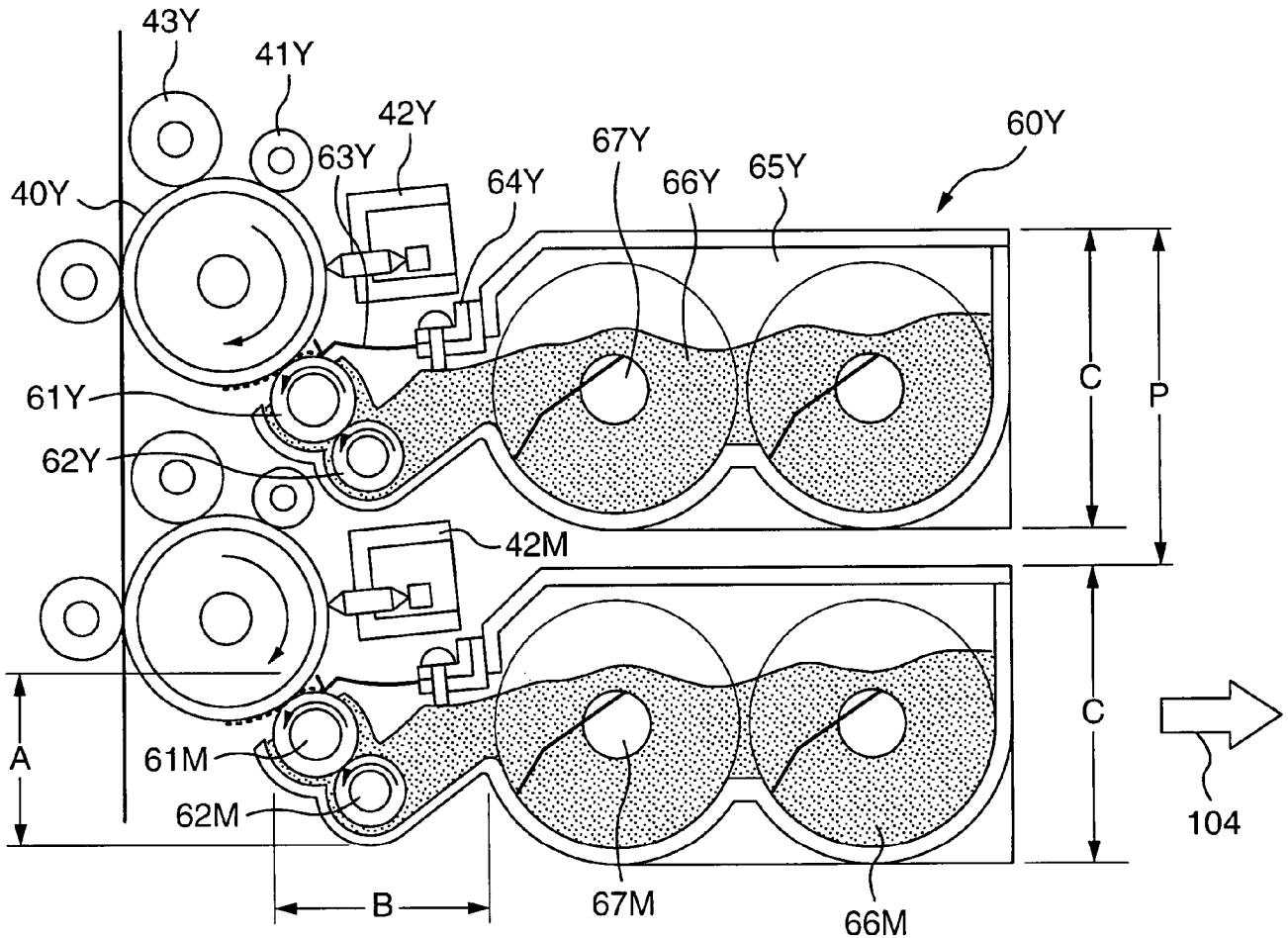
FIG. 4 is a cross sectional view showing a constitution of an essential part of a second embodiment of an electrophotographic apparatus according to the invention.

FIG. 4 is a cross sectional view showing a constitution of an essential part of a second embodiment of an electrophotographic apparatus according to the invention.

In the second embodiment, a bottom of a tip end part 71 of a developing means, that is, a bottom close to a supplying roller 62 and a bottom of a toner storage part 65 are arranged on substantially the same plane.

The remainder of a constitution is the same as that in the first embodiment, and so an explanation therefor is omitted.

Also in the second embodiment, a heightwise dimension of the tip end part 71 of the developing means is decreased to meet the condition A<P−Lb and the condition B>Lb in the same manner as in the first embodiment, so that a stacking pitch P of image forming means 70 can be made at most 2 times a diameter of photosensitive drums.

Figure 5:
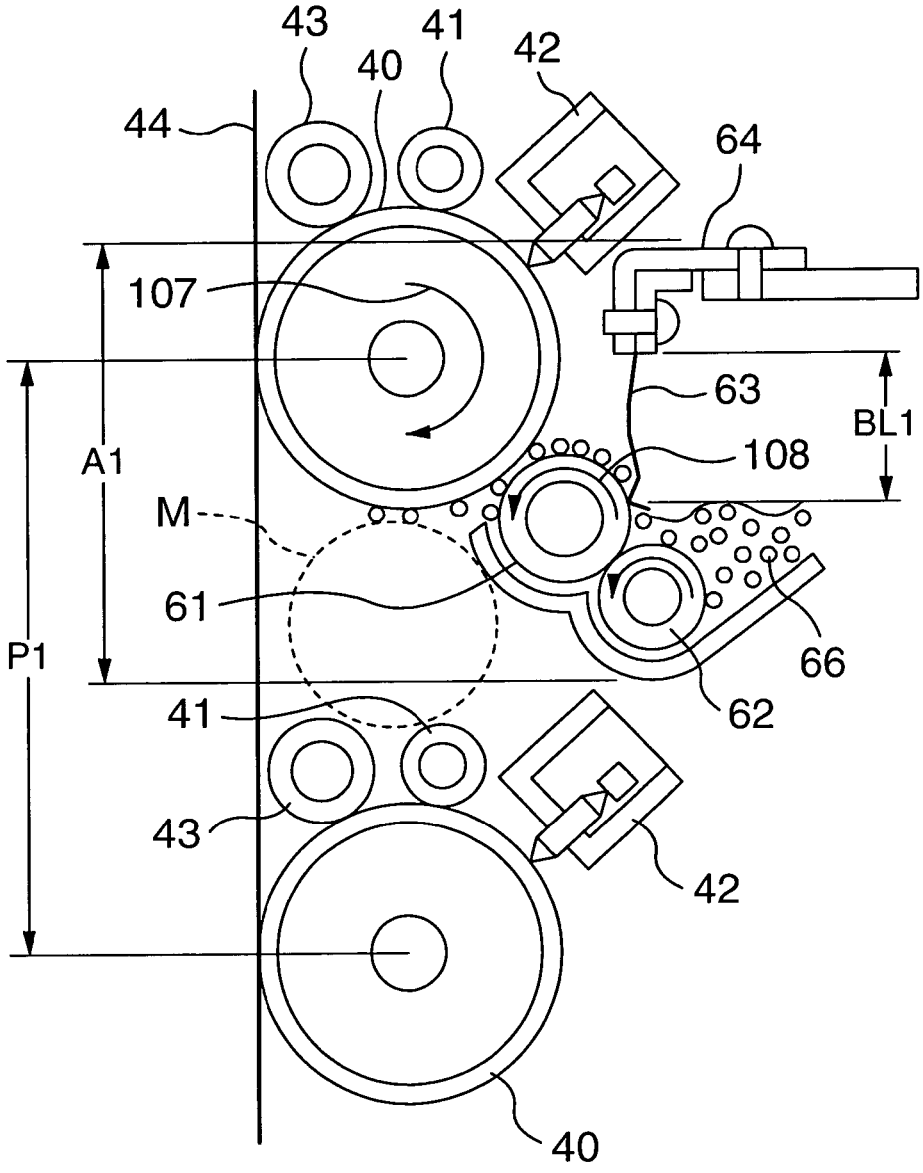
FIG.5 PRIOR ART
FIG. 5 is a cross sectional view showing a prior art example of arrangement of a toner regulatory blade in a tip end part of developing means.

FIG. 5 is a cross sectional view showing a conventional example of arrangement of a toner regulatory blade in a tip end part of developing means.

In the first and second embodiments shown in FIGS. 2 and 4, the toner regulatory blade 63 substantially are in contact with the top of the upper surface of the developing roller 61 in the direction following the rotation of the roller. Making a comparison between FIGS. 4 and 5, it will be illustrated that the first and second embodiments of the invention are effective in making the tip end part 71 of the developing means thin.

In the prior art example shown in FIG. 5, a toner regulatory blade 63 is arranged in a direction against rotation of the developing roller 61. Since the toner regulatory blade 63 is arranged substantially in parallel with an intermediate transfer belt 44, a dimension A1 of a tip end part 71 of a developing means along the intermediate transfer belt 44 is increased by a spring length BL1 of the toner regulatory blade 63 and a part size of toner regulatory blade mount means 64.

Further, since exposure means 42 must be arranged so as not to interfere with the tip end part of the developing means, an idle space M is produced, so that a pitch P1, at which photosensitive drums 40 are arranged, is increased to place a limit upon miniaturization of an image forming apparatus.

Figure 6:
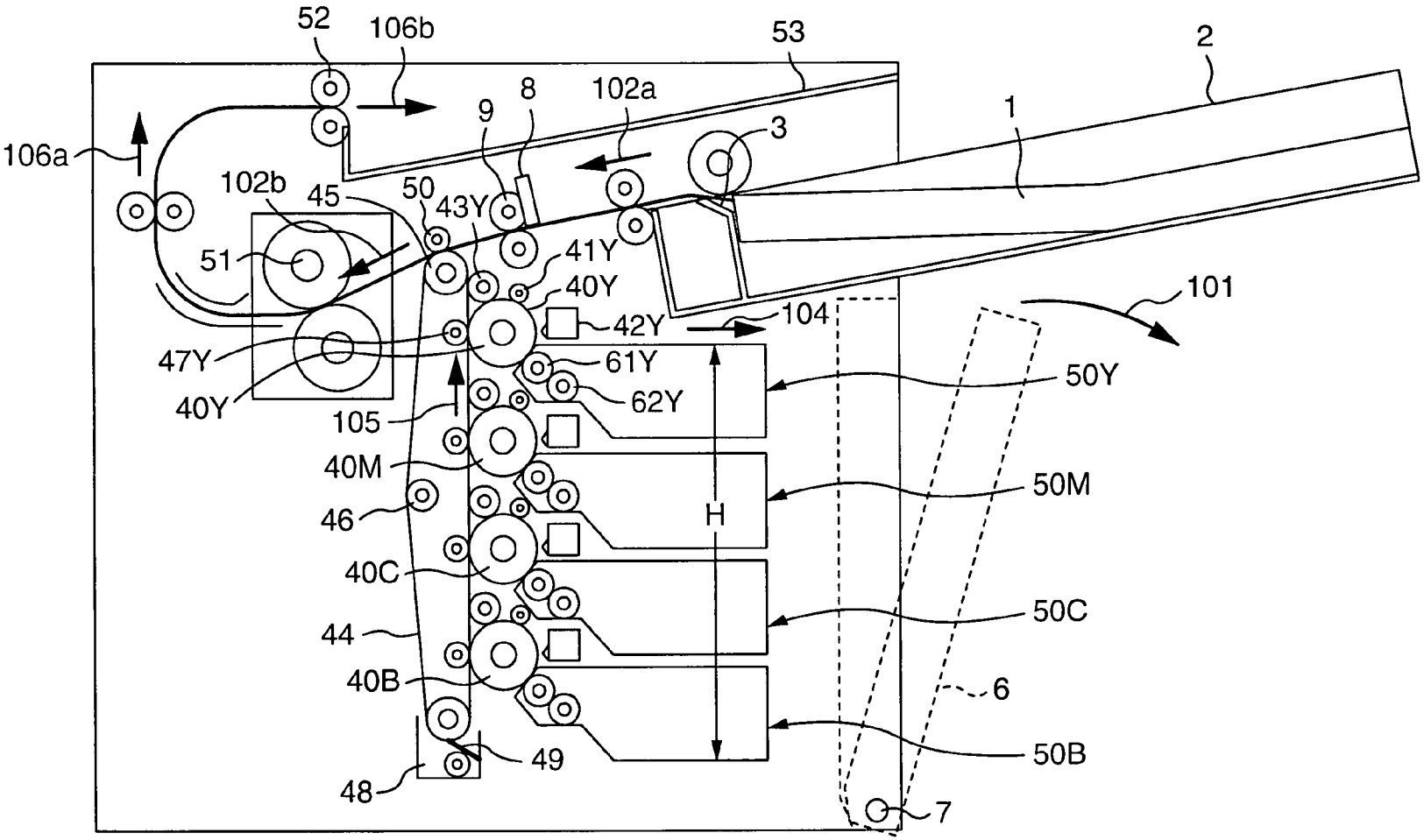
FIG. 6 is a cross sectional view showing a whole constitution of a third embodiment of an electrophotographic apparatus according to the invention.

FIG. 6 is a cross sectional view showing a whole constitution of a third embodiment of an electrophotographic apparatus according to the invention.

In the third embodiment, a sheet cassette 2 is arranged to project upward from a front surface of a casing 100. Sheet separation means 3 is installed on an end of the sheet cassette 2 in an upper portion of the casing 100. As a result, a conveyance path 5 is shortened to extend toward registration rollers 9 from the end of the sheet cassette 2 in the upper portion of the casing 100, and conveyance means 4 mounted inside an opening and closing door 6 disappears.

The remainder of a constitution is the same as that in the first embodiment, and so description therefor is omitted.

According to the third embodiment, the same effect as that in the first embodiment is produced, the opening and closing door 6 is made simple in construction, and the conveyance path 5 is decreased in length and includes less curved portions.

Figure 7:
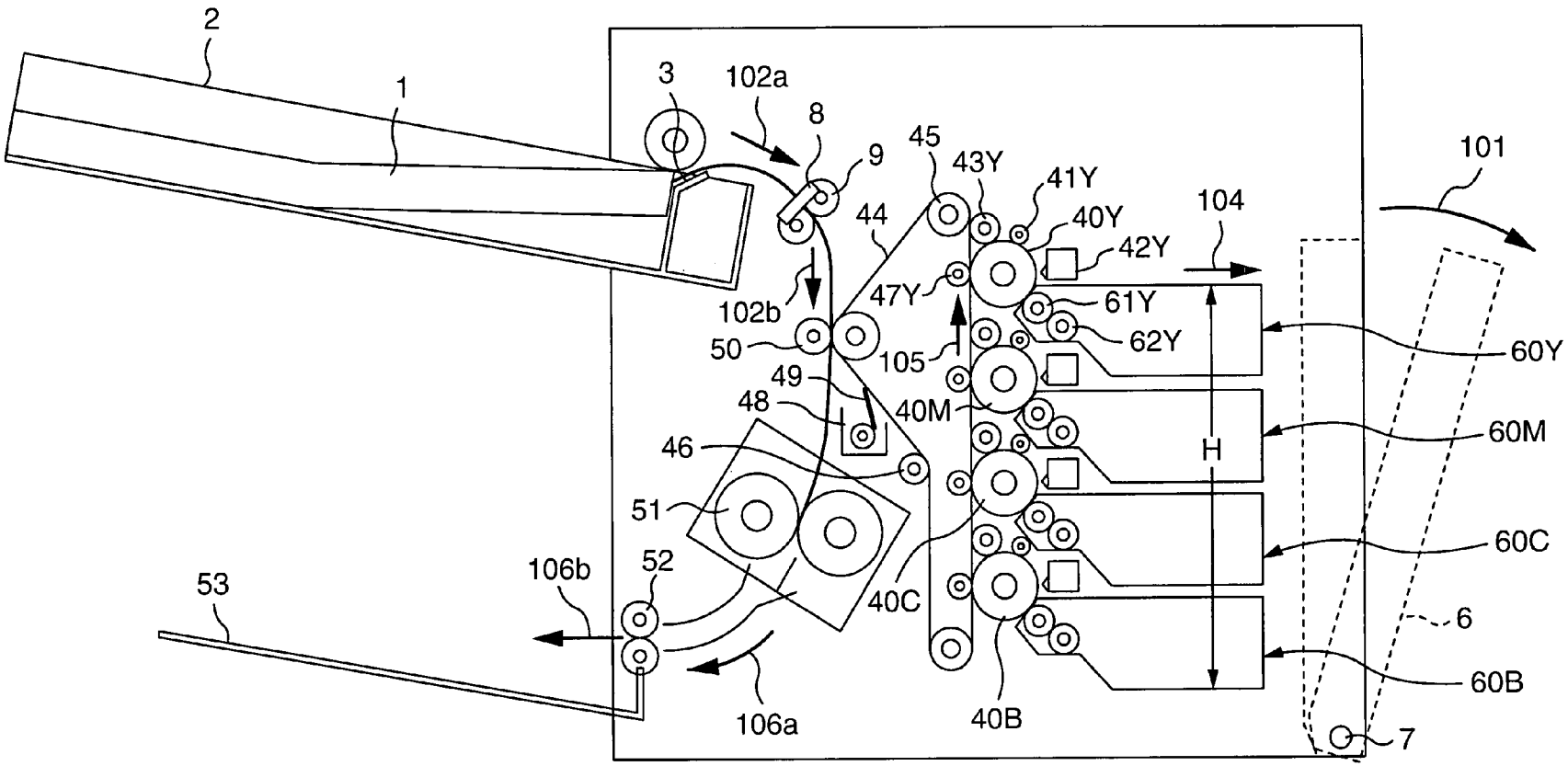
FIG. 7 is a cross sectional view showing a whole constitution of a fourth embodiment of an electrophotographic apparatus according to the invention.

FIG. 7 is a cross sectional view showing a whole constitution of a fourth embodiment of an electrophotographic apparatus according to the invention.

In the fourth embodiment, a sheet cassette 2 is arranged on an upper portion of a back surface of a casing 100 to project upwardly and rearwardly therefrom. A sheet ejection tray 53 is also arranged to project from a lower portion of a back surface of the casing 100.

A tension regulatory roller 46 is arranged on a back surface side of an intermediate transfer belt 44. A second transfer roller 50 is arranged between the tension regulatory roller 46 and a drive roller 45 on the back surface side of the intermediate transfer belt 44. A roller causing the intermediate transfer belt 44 to project toward the back surface side thereof is positioned to be opposed to the second transfer roller 50 with the intermediate transfer belt 44 therebetween.

As a result, a conveyance path 5 is arranged not on a side of developing means 60Y, 60M, 60C, 60B to an opening and closing door 6 but on the back surface side of the intermediate transfer belt 44 in a vertically downward direction to pass between the second transfer roller 50 and the intermediate transfer belt 44.

Transfer cleaning means 48 is arranged between the second transfer roller 50 and the tension regulatory roller 46 in contact with the intermediate transfer belt 44.

The remainder of a constitution is the same as that in the first embodiment, and so description therefor is omitted.

In the fourth embodiment, a sheet 1 paid out from the sheet cassette 2 arranged on the upper portion of the back surface of the casing 100 advances downward in the conveyance path 5 to undergo transfer of a toner image on the intermediate transfer belt 44 in a position, in which the intermediate transfer belt 44 projects toward the back surface side thereof, at the time of passage between the second transfer roller 50 and the intermediate transfer belt 44, and passes through a fixing device 51 to be recovered into the sheet ejection tray 53, which projects from the lower portion of the back surface of the casing 100, by the sheet ejection rollers 52.

According to the fourth embodiment, the same effect as that in the first embodiment is produced, the opening and closing door 6 is made simple in construction, and the conveyance path 5 is decreased in length and decreased in curved portions.

Figure 8:
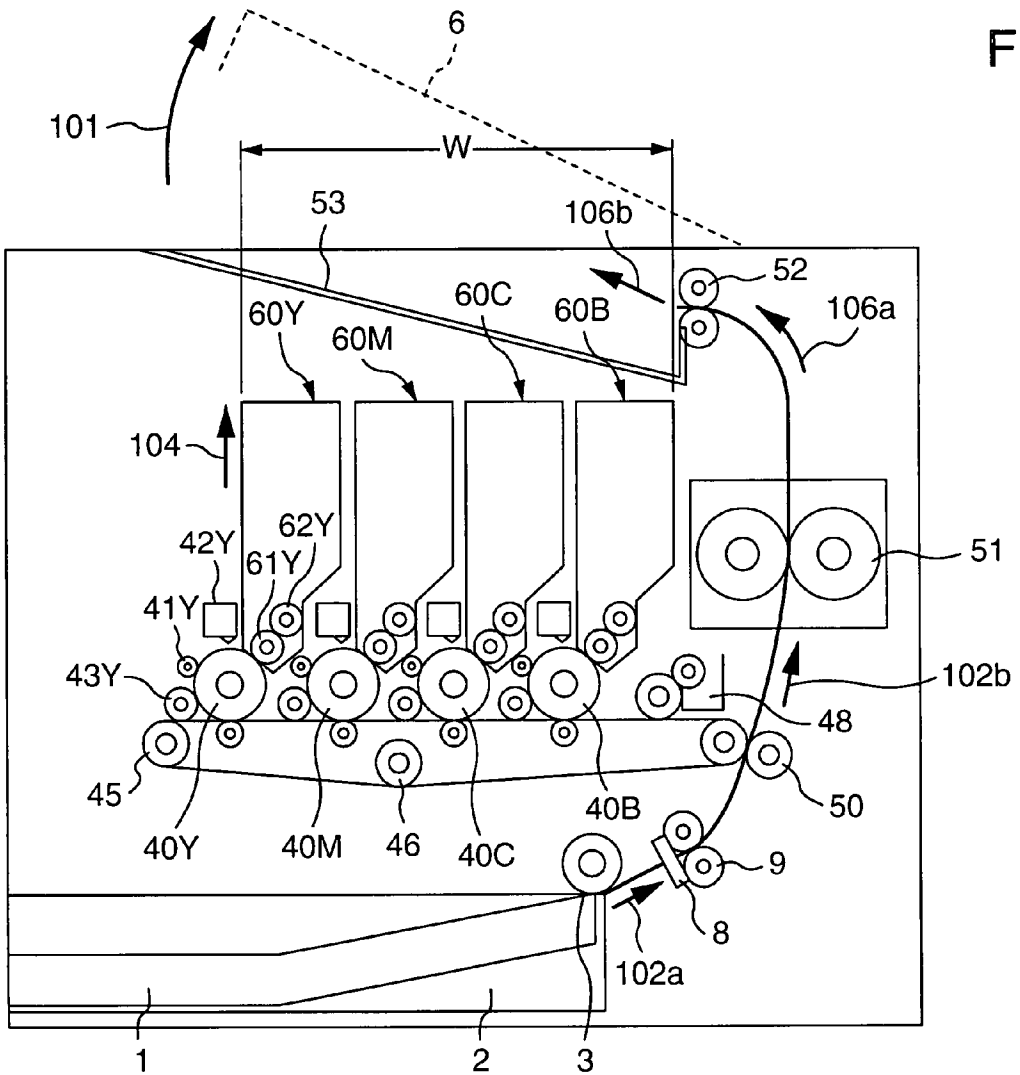
FIG. 8 is a cross sectional view showing a whole constitution of a fifth embodiment of an electrophotographic apparatus according to the invention.

FIG. 8 is a cross sectional view showing a whole constitution of a fifth embodiment of an electrophotographic apparatus according to the invention.

In the fifth embodiment, an intermediate transfer belt 44 is stretched substantially horizontally, image forming means 70 are arranged in a horizontal direction so that optical axes of exposure means are directed vertically, and an opening and closing door 6 formed therein with a sheet ejection tray 53 is provided on an upper surface of a casing 100 to be openable upward, whereby developing means are adapted to be taken out upwardly of the casing 100.

The remainder of a constitution is the same as that in the first embodiment, and so description therefor is omitted.

Also, in the fifth embodiment, it is possible to realize small-sizing and high-density mounting of a tandem-type color printer.

Figure 9:
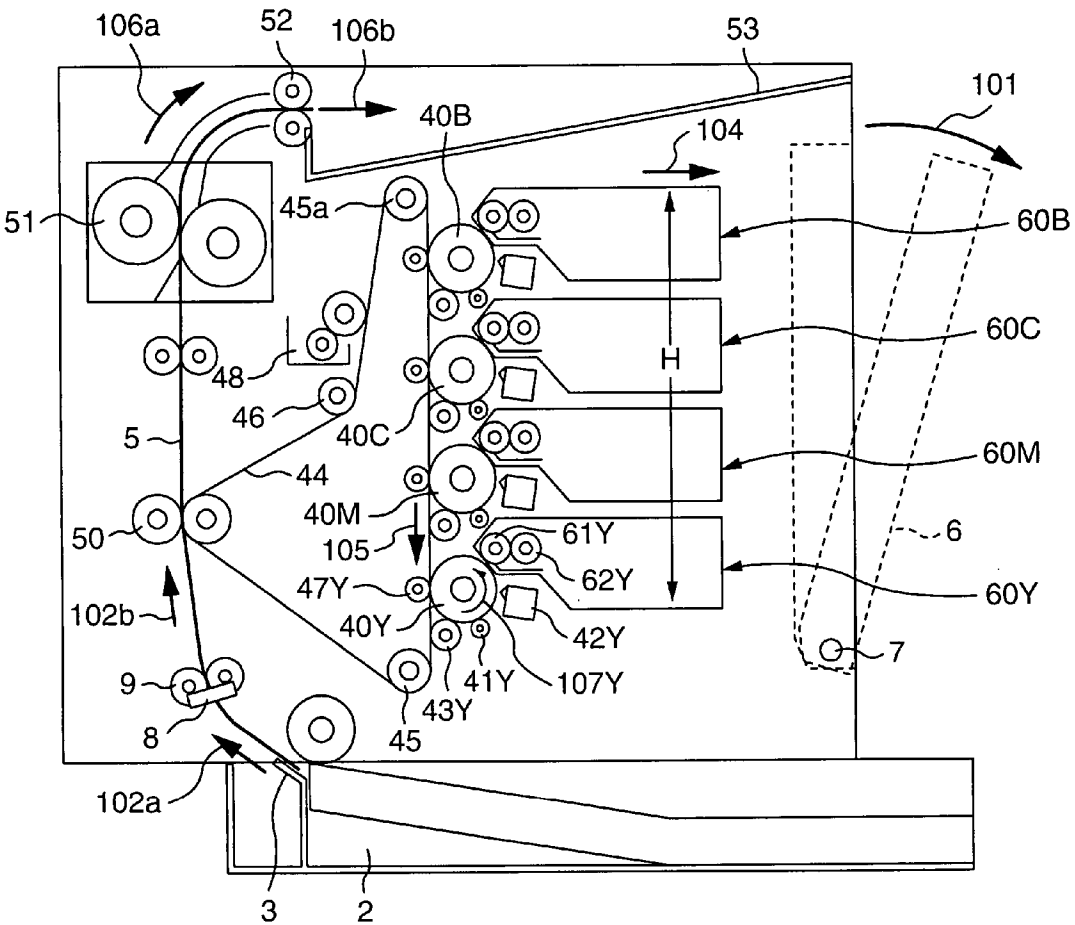
FIG. 9 is a cross sectional view showing a whole constitution of a sixth embodiment of an electrophotographic apparatus according to the invention.

FIG. 9 is a cross sectional view showing a whole constitution of a sixth embodiment of an electrophotographic apparatus according to the invention.

In the sixth embodiment, a sheet cassette 2 is arranged on a bottom of a casing 100, and a sheet ejection tray 53 is arranged in an upper portion of the casing 100. As a result, a drive roller 45 is arranged in a lower area, a driven roller 45*a* is arranged in an upper area, and an intermediate transfer belt 44 is revolved in a clockwise direction indicated by an arrow 105. Photosensitive drums 40Y, 40M, 40C, and 40B are rotated in a counterclockwise direction indicated by an arrow 107, and developing rollers 61 and supplying rollers 62 are rotated in a clockwise direction.

A sheet having been paid out from the sheet cassette 2 is fed upward on a back surface side of the casing. A conveyance path 5 permits a sheet having been paid out from the sheet cassette to pass between a second transfer roller 50 and the intermediate transfer belt 44 to be conveyed upward, and to be directed to a front surface of the casing after passage through a fixing device 51 to be fed into a sheet ejection tray 53. Transfer cleaning means 48 comprises a cleaning roller adapted to come into contact with the intermediate transfer belt 44 to rotate, and is arranged above a tension regulatory roller 46.

The remainder of a constitution is the same as that in the fourth embodiment, and so description therefor is omitted.

In the sixth embodiment, since the developing roller 61 and the supplying roller 62 are rotated in a reverse direction to that in the embodiments illustrated in FIGS. 1 to 8, a tip end part of a developing means is in construction turned upside down relative to the constitution shown in FIGS. 2 to 4. More specifically, exposure means 42 is arranged below an associated developing means 60, and cleaner means 43 and charging means 41 are also arranged below the associated photosensitive drum 40.

A sheet 1 is conveyed in a direction indicated by arrows 102*a*, 102*b*. A color image formed on the intermediate transfer belt 44 is transferred to the sheet 1 by the second transfer roller 50 to be fixed by the fixing means 51 and conveyed in a direction indicated by arrows 106*a*, 106*b* to be ejected into the sheet ejection tray 53.

According to the sixth embodiment, the same effect as that in the first embodiment is produced, the opening and closing door 6 is made simple in construction, and the conveyance path 5 is decreased in length and includes less curved portions.

Figure 10:
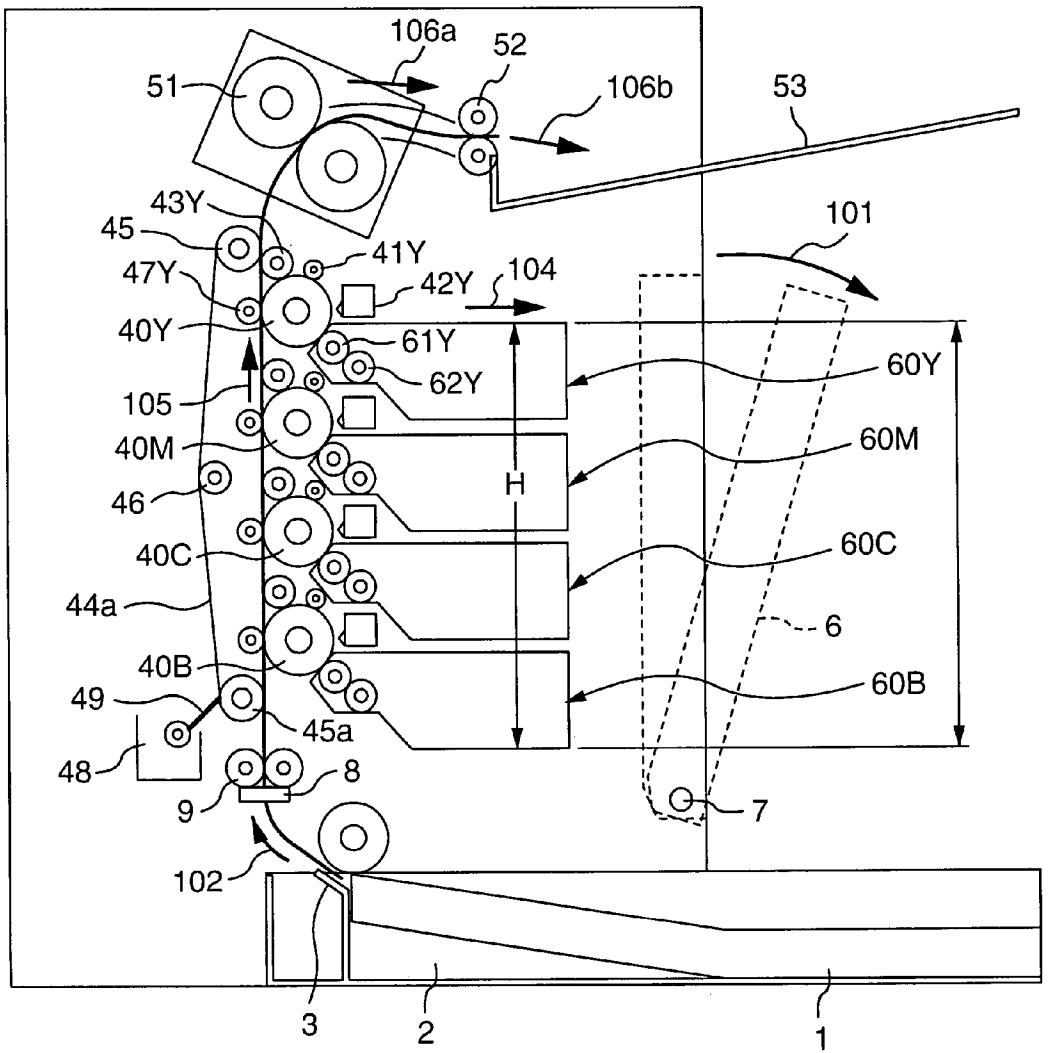
FIG. 10 is a cross sectional view showing a whole constitution of a seventh embodiment of an electrophotographic apparatus according to the invention.

FIG. 10 is a cross sectional view showing a whole constitution of a seventh embodiment of an electrophotographic apparatus according to the invention.

In the seventh embodiment, toner images formed on photosensitive drums 40 are transferred directly to a sheet 1 to form an image without the use of any intermediate transfer belt 44.

A sheet conveyance belt 44*a* trained around a drive roller 45, a driven roller 45*a* and a tension regulatory roller 46 is revolved in a counterclockwise direction indicated by an arrow 105 to serve for sheet conveyance.

The remainder of a constitution is the same as that in the fourth embodiment, and so description therefor is omitted.

A sheet 1 is paid out toward a back surface side of a casing from a sheet cassette 2, which is provided to project partly from a casing front surface, to be fed upward by guide means (not shown) to pass through sheet position detection means 8 and registration rollers 9 to be fed between photosensitive drums 40 and the sheet conveyance belt 44*a*.

The sheet 1 having been fed between the photosensitive drums 40 and the sheet conveyance belt 44*a* is conveyed upward while toner images on photosensitive drums 40B, 40M, 40C, and 40Y are successively transferred to the sheet 1, and the images are fixed by the fixing means 51, the sheet 1 being changed in direction to advance toward a front surface of the casing 100 to be ejected into a sheet ejection tray 53, which is provided to project partly from the front surface of the casing 100, by sheet ejection rollers 52.

According to the seventh embodiment, the same effect as that in the first embodiment is produced, the opening and closing door 6 is made simple in construction, any intermediate transfer belt 44 is dispensed with, and the conveyance path 5 is decreased in length and includes less curved portions.

Figure 11:
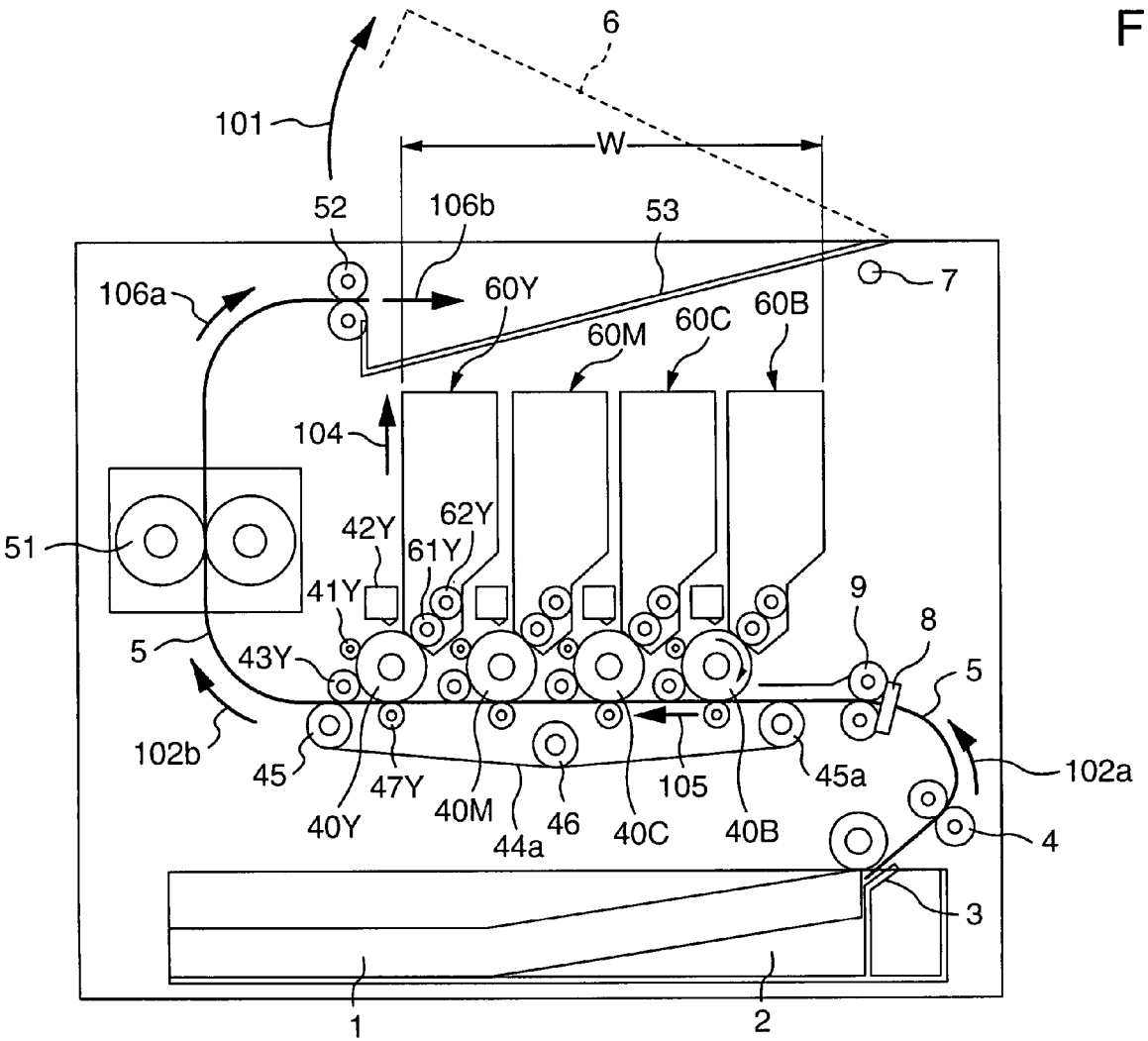
FIG. 11 is a cross sectional view showing a whole constitution of an eighth embodiment of an electrophotographic apparatus according to the invention.

FIG. 11 is a cross sectional view showing a whole constitution of an eighth embodiment of an electrophotographic apparatus according to the invention.

In the eighth embodiment, any intermediate transfer belt 44 is not used, and toner images formed on photosensitive drums 40 are transferred directly to a sheet 1 to form an image. A sheet conveyance belt 44*a* trained around a drive roller 45, a driven roller 45*a* and a tension regulatory roller 46 are revolved in a counterclockwise direction indicated by an arrow 105 to serve for sheet conveyance. A fixing device 51 is provided on a side of the drive roller 45 in a casing 100.

A conveyance path 5 permits a sheet having been paid out rightward from a sheet cassette 2 to be conducted upward by a guide (not shown) and directed leftward to pass through sheet position detection means 8 and registration rollers 9 to be fed between the photosensitive drums 40 and the sheet conveyance belt 44*a*.

Toner images on photosensitive drums 40B, 40M, 40C, and 40Y are successively transferred to the sheet having been fed between the photosensitive drums 40 and the sheet conveyance belt 44*a*. The sheet, to which toner images have been successively transferred, is directed upward to pass through the fixing device 51, during which toner images are fixed. The sheet, to which toner images have been fixed, is directed forward in the casing 100 to be ejected into a sheet ejection tray 53 by sheet ejection rollers 52.

The remainder of a constitution is the same as that in the fifth embodiment, and so description therefor is omitted.

According to the eighth embodiment, the same effect as that in the first embodiment is produced, and any intermediate transfer belt 44 is dispensed with.

Figure 12:
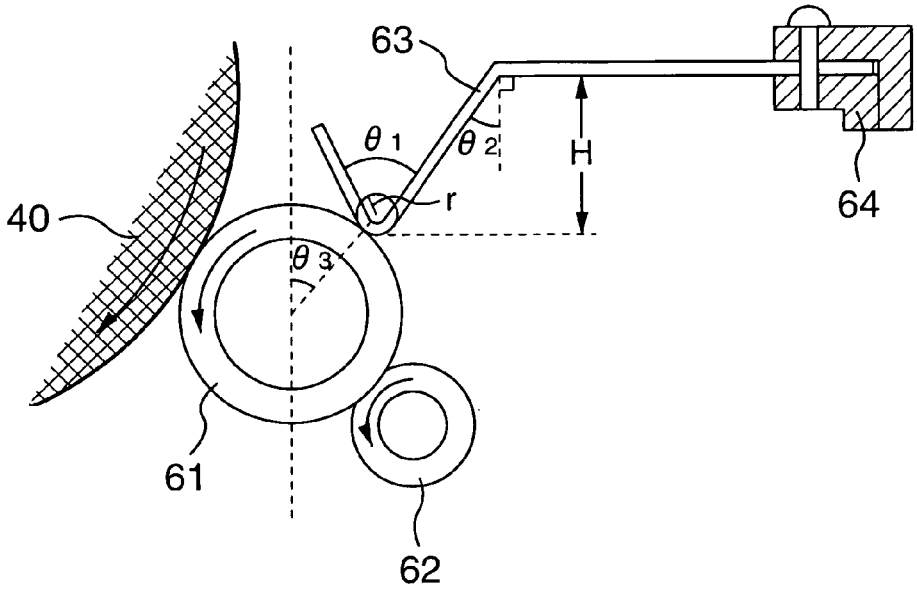
FIG. 12 is a view showing a concrete construction of an embodiment of a toner regulatory blade and mount means therefor.

FIG. 12 is a view showing a concrete construction of an embodiment of a toner regulatory blade and mount means therefor.

In this embodiment, toner regulatory blade mount means 64 is disposed on an upstream side from a contact point between the toner regulatory blade 63 and a developing roller 61 in a direction of rotation of the developing roller 61, and a leaf spring portion of the toner regulatory blade is arranged in a direction along a normal to a straight portion of an intermediate transfer belt, or a sheet conveyance belt, that is, horizontally.

Also, the toner regulatory blade comprises an integrally formed product, which is formed by bending a spring material at least once.

When the toner regulatory blade 63 is positioned upstream in a direction of rotation of the developing roller 61 and secured in a following direction, a developing means can be formed thin in a heightwise direction while ensuring a length of the toner regulatory blade 63 in a horizontal direction.

The leaf spring portion of the toner regulatory blade forms an arm extending toward the developing roller 61 from a mount of the toner regulatory blade 63. A first bending extends the arm further toward the contact portion with the developing roller 61. A bent formed by the first bending forms an angle $\theta_2$ relative to the vertical direction.

Another bent is formed on a tip end of the arm by second bending. The bent generated by second bending is formed to have a radius of curvature r.

In the case where the toner regulatory blade has a tip end in the form of a flat plate, pressure distribution on the developing roller spreads to cause insufficiency in regulatory forces.

When the toner regulatory blade has a semi-arcuate tip end, a contact area with the developing roller is small as compared with the form of a flat plate, so that an increase in regulatory force is resulted. The smaller the radius of curvature, the larger the regulatory force, but lifetime is shortened since stress on the developing roller is correspondingly increased. Accordingly, it is desired that a tip end of the toner regulatory blade have a radius of curvature at least in the range of 0.2 mm to 1.0 mm. When the tip end of the toner regulatory blade is made semi-arcuate to have a radius of curvature in this range, a thin toner layer can be stably formed on the developing roller over a long term.

Also, the toner regulatory blade is generally secured in an axial direction of the developing roller with the use of a plurality of screws. In the case where pressure distribution of the screws for securement of the toner regulatory blade becomes uneven, the blade tip end in the form of a flat plate is small in rigidity in an axial direction to permit unevenness of pressure distribution on the secured portion to be transmitted to a small area of the developing roller, so that unevenness in pressure between the developing roller and the blade is liable to generate unevenness in toner concentration.

In contrast, since the semi-arcuate tip end in the invention is large in rigidity in an axial direction of the blade as compared with the blade tip end in the form of a flat plate, even if there is an unevenness in pressure distribution on the secured portion, the unevenness is dispersed over a wide area of the developing roller. As a result, pressure distribution between the blade and the developing roller in the axial direction can be made substantially even.

When a supplying roller 62 rotates faster than the developing roller in the case where a thin toner layer is to be formed on the developing roller, a large amount of toner can be fed to a surface of the developing roller 61. A disused toner among toner fed to the surface of the developing roller in large amount is scraped off by the second bent of the toner regulatory blade. As a result, the disused toner as scraped off will remain in the neighborhood of the contact portion.

Hereupon, as a way to efficiently circulate the remaining toner, a contact portion between the developing roller and the toner regulatory blade is regulated such that an angle $\theta_3$ of a line extending to the contact portion from an axis of the developing roller, relative to the vertical passing through the axis of the developing roller comes at least in the range of 10° to 60°, whereby toner remaining in the neighborhood of the contact portion between the developing roller and the toner regulatory blade is liable to be helped by gravity and circulation of the remaining toner is promoted.

Subsequently, a length of the arm of the toner regulatory blade is made at least 1.5 mm or lager to adequately ensure a space (circulation space) defined by the developing roller and the arm and spring portion of the toner regulatory blade on an upstream side of the contact portion between the developing roller and the toner regulatory blade in a direction of rotation of the developing roller, whereby it is possible to suppress toner filming on the blade or the roller, which the remaining toner stays in the neighborhood of the contact portion between the toner regulatory blade and the developing roller to generate.

A bending angle $\theta_1$ of the bent of the toner regulatory blade is desirably an acute angle of less than 90° in order to prevent a planar portion, which extends further from the contact portion of the toner regulatory blade, from coming into contact with the developing roller.

Also, an angle $\theta_2$ formed between an arm of the toner regulatory blade connecting to the contact portion to the developing roller and a line drawn in parallel to the straight portion of the intermediate transfer belt or of the medium conveyance belt and an angle $\theta_3$ formed between a line connecting the center of the developing roller and the contact portion and the parallel drawn line have relationship $\theta_2 \geqq \theta_3$.

Further, since there is a fear that the toner circulation space is decreased when toner adheres to a lower portion of the toner regulatory blade, below which toner circulates, there may be adopted a coating method for preventing the toner from adhering by means of a chemical processing, for example, thin layer coating processing of polytetrafluoroethylene resin, or the like.

In addition, when the toner regulatory blade is formed by bending of a spring material, such as SUS, phosphor bronze, or the like, having a relatively good thermal conductivity, the toner regulatory blade can serve as a heat sink for cooling heat generated at the contact portion with the developing roller.

Figure 13:
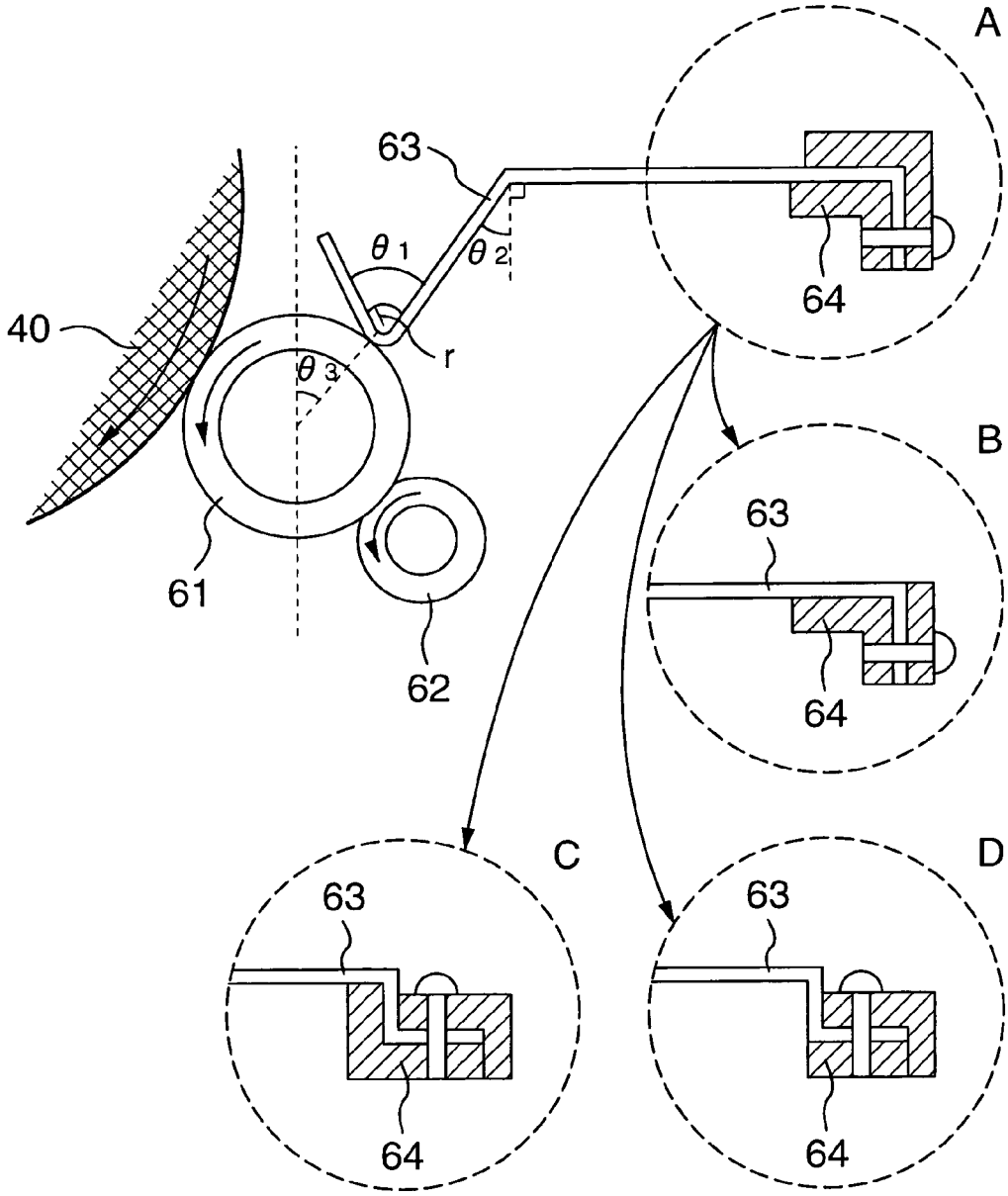
FIG. 13 is a view showing a concrete construction of another embodiment of a toner regulatory blade and mount means therefor.

FIG. 13 is a view showing a variation of toner regulatory blade mount means.

The toner regulatory blade mount means shown in FIG. 12 adopts a construction, in which an end of the toner regulatory blade is interposed between two L-shaped plates and which is constructionally strengthened and makes the toner regulatory blade detachable from the developing means.

Mount means shown in FIG. 13(A) can be decreased in heightwise thickness since a rear end of a toner regulatory blade is once bent and interposed by two L-shaped plates to be secured horizontally by means of lock screws. While the screws shown in FIG. 13(A) are screwed from the right side, they may be screwed from the left side.

Mount means shown in FIG. 13(B) can be further decreased in heightwise thickness since a rear end of a toner regulatory blade is once bent and interposed by a L-shaped plate and a planar plate to be secured horizontally by means of lock screws. While the screws shown in FIG. 13B are screwed from the right side, they may be screwed from the left side.

Mount means shown in FIG. 13(C) can be further decreased in heightwise thickness since a rear end of a toner regulatory blade is twice bent and interposed by two L-shaped plates to be secured vertically by means of lock screws. While the screws shown in FIG. 13C are screwed from the above, they may be screwed from the under.

Mount means shown in FIG. 13(D) can be further decreased in heightwise thickness since a rear end of a toner regulatory blade is twice bent and interposed by a L-shaped plate and a planar plate to be secured vertically by means of lock screws. While the screws shown in FIG. 13D are screwed from the above, they may be screwed from the under.

Figure 14:
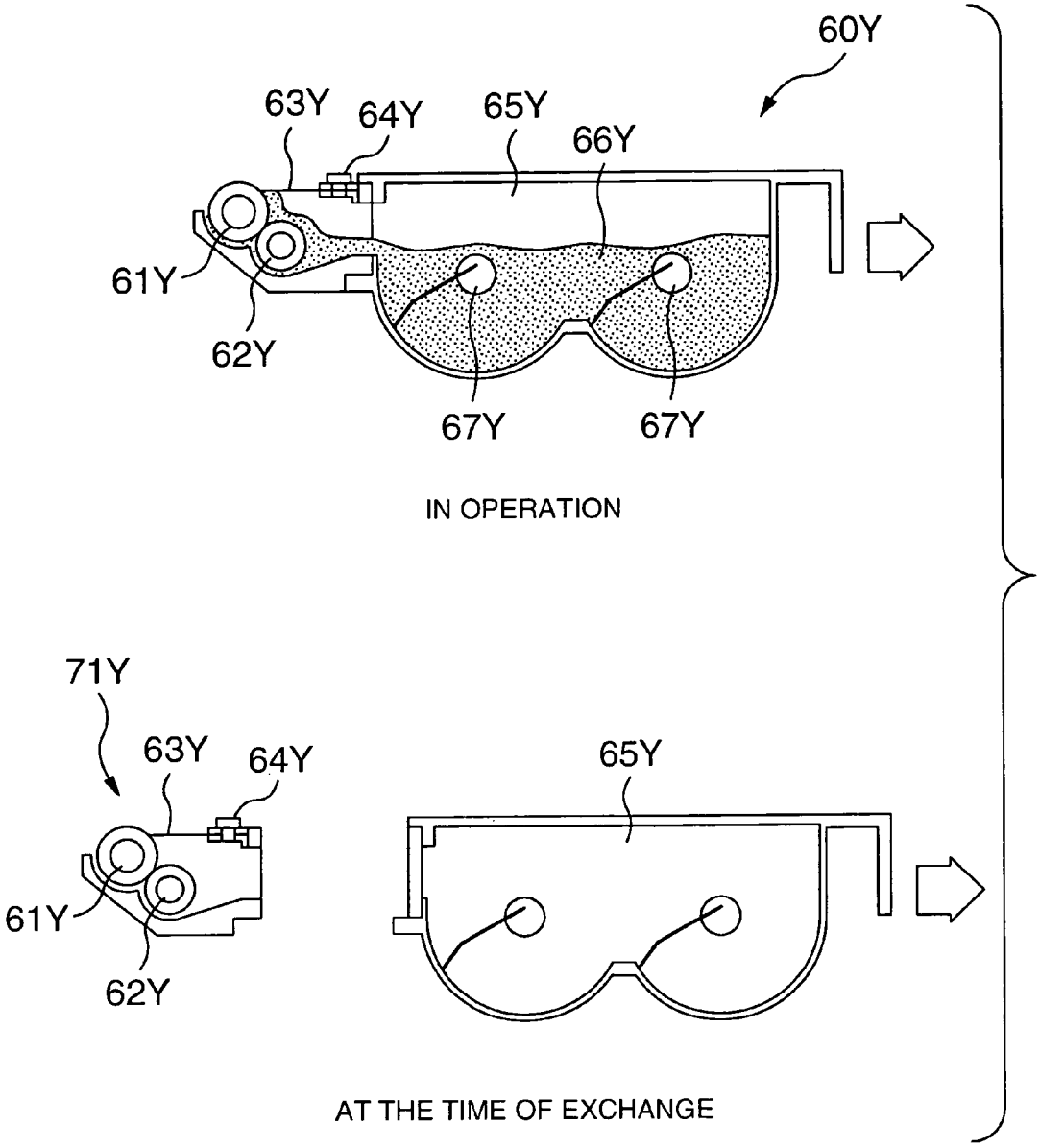
FIG. 14 is a view showing a concrete construction of an embodiment of developing means, in which a tip end part of a developing means and a toner recovery part are separable from each other.

FIG. 14 is a view showing a concrete construction of an embodiment of developing means, in which a tip end part of the developing means and the toner recovery part are separable from each other.

According to the respective embodiments related to the toner regulatory blade and mount means, there is obtained developing means provided with the tip end part, which is substantially free from the toner filming phenomenon and the phenomena of an increase in a passing toner and insufficiency of electrification of toner due to insufficiency of toner regulating forces.

Since the tip end part of the developing means of the present invention can be expected to have a considerably long lifetime as compared with conventional ones, it needs not to be exchanged together with the toner storage part whenever toner is exhausted.

Hereupon, the example shown in FIG. 14 adopts a construction, in which a tip end part 71Y of a developing means 60Y is fixed to a body of an electrophotographic apparatus and only a toner storage part 65Y of the developing means 60 can be mounted and dismounted from the body of the electrophotographic apparatus.

According to the above-described example, since it suffices to exchange only the toner storage part 65 of the developing means 60 when toner is exhausted, it is possible to reduce a running cost.

According to the respective embodiments, the toner regulatory blade made of a leaf spring is arranged so that a straight line connecting between the secured end of the toner regulatory blade and its contact point to the developing roller runs along a normal to the intermediate transfer belt 44 or the sheet conveyance belt 44*a*, so that the tip end part of the developing means can be made thin.

Also, independently of a pitch, at which the image forming means 70 are stacked, a length of a leaf spring is easily ensured to decrease a spring constant, whereby that dispersion in pressing forces on the developing roller, which is caused by an error in a spring mount position, warp of a spring, and deformation of a spring, is restricted, thus enabling forming a stable, thin toner layer.

According to the respective embodiments, the tip end part of the developing means is made thin to enable arranging exposure means, such as LED array, or the like, in a space formed by the tip end part of the developing means and the toner storage part. As a result, it is possible to provide a small-sized image forming apparatus and a small-sized color tandem-type printer, in which a longitudinal pitch when the image forming means 70 comprising a photosensitive body, charging means, exposure means, developing means, and cleaner means are stacked vertically on one another, or a lateral pitch when the image forming means 70 are stacked horizontally on one another, can be decreased and in which high-speed printing is possible even in the case where a plurality of photosensitive bodies are used.

Also, when toner is exhausted and developing means is to be exchanged, developing means can be exchanged in an operation, in which developing means is linearly taken out/inserted. Such linear operation is an easiest one, and so a work, in which an end user performs exchange of developing means 60 when toner is exhausted, is facilitated to improve convenience in use.

According to the invention, it is possible to decrease a longitudinal pitch when the image forming means 70 are stacked vertically, or a lateral pitch when the image forming means are stacked horizontally, and to provide a small-sized color tandem-type printer.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. An electrophotographic apparatus comprising a plurality of image forming devices each comprising a photosensitive drum provided on a surface thereof with a photosensitive layer, a charging device for having the photosensitive layer charged at a predetermined electric potential, an exposure device for subjecting the photosensitive layer to exposure on the basis of image data to form an electrostatic latent image, and a developing device for adhering toner to the electrostatic latent image on the photosensitive drum to form a toner image, and wherein the plurality of image forming devices are arranged vertically along a straight portion of an endless intermediate transfer belt, which is stretched around a drive roller and a driven roller to revolve, or of a medium conveyance belt in such a manner that each photosensitive drum is in contact with an outer peripheral surface of the straight portion to transfer the toner image formed on the photosensitive drum through the intermediate transfer belt or directly to a medium to form a color image, and wherein each developing device comprises a tip end part and a toner storage part, coupled to the tip end part, to store toner, said tip end part comprising a developing roller in contact with the photosensitive drum to rotate to form a thin toner layer on a surface of the photosensitive drum, a supplying roller for supplying toner to the developing roller, and a toner regulatory blade brought into linear contact with an outer peripheral surface of the developing roller at a predetermined pressure to form a thin toner layer on the surface of the photosensitive drum, and wherein a thickness of the tip end part of each developing device in a direction of movement of the intermediate transfer belt or the medium conveyance belt is smaller than a thickness of the toner storage part in the direction of movement, and wherein each exposure device is arranged near the tip end part of each developing device, each exposure device comprising an LED array arranged in a widthwise direction of an associated photosensitive drum, and wherein a sum of thickness of the tip end part of the developing device and thickness of the toner storage part in the direction of movement of the intermediate transfer belt or the medium conveyance belt is at most 2 times a diameter of the photosensitive drum.

2. The electrophotographic apparatus according to claim 1, wherein in a space formed by the tip end part of the developing device and the toner storage part of the developing device of a first image forming device of said plurality of image forming devices, the exposure device and the charging device of said first image forming device, or the exposure device and the charging device of a second image forming device which is arranged adjacent to said first image forming device for a different color are arranged.

3. The electrophotographic apparatus according to claim 1, wherein the tip end part of the developing device is fixed to a body of the electrophotographic apparatus and only the toner storage part of the developing device is detachably mounted in the body of the electrophotographic apparatus.

4. The electrophotographic apparatus according to claim 1, wherein the LED array comprises 600 to 1200 LEDs per 1 inch.

5. The electrophotographic apparatus according to claim 1, wherein the toner regulatory blade extends in a direction along a normal to the straight portion of the intermediate transfer belt or of the medium conveyance belt and arranged so as to come into contact with the developing roller from a direction following rotation of the developing roller.

6. The electrophotographic apparatus according to claim 5, wherein the toner regulatory blade is made of a spring plate formed with at least one bend, and the toner regulatory blade is brought into contact with the developing roller at a position between about 10° and about 60° from a vertical line passing through the axis of the developing roller toward an upstream direction of rotation of the developing roller.

7. The electrophotographic apparatus according to claim 5, wherein the toner regulatory blade has a cross sectional shape of symbol √having a first bend and a second bend, and the toner regulatory blade includes a first arm of a predetermined length between the first bend and the second bend and a second arm of a length of several milliliters beyond the second bend, said second bend having a radius of curvature of 0.2 to 1.0 mm.

8. The electrophotographic apparatus according to claim 7, wherein a space formed by the toner regulatory blade and the developing roller in an upstream direction of rotation of the developing roller has an extent sufficient for toner circulation, and the predetermined length of said first arm is at least 1.5 mm.

9. The electrophotographic apparatus according to claim 8, wherein said second bend has an angle of less than 90° and an angle formed between the first arm of the toner regulatory blade and a line drawn in parallel to the straight portion of the intermediate transfer belt or of the medium conveyance belt is equal to or larger than an angle formed between a line connecting the center of the developing roller and the contact portion and said parallel drawn line.

10. The electrophotographic apparatus according to claim 9, wherein the toner regulatory blade is made of a spring material, such as SUS, phosphor bronze, or the like, having a good thermal conductivity.

11. The electrophotographic apparatus according to claim 10, wherein the toner regulatory blade has coating for inhibiting adherence of toner between the contact portion and a mount potion.

12. The electrophotographic apparatus according to claim 5, wherein the tip end part of the developing device is fixed to a body of the electrophotographic apparatus and only the toner storage part of the developing device is detachably mounted in the body of the electrophotographic apparatus.

13. An electrophotographic apparatus comprising a plurality of image forming devices each comprising a photosensitive drum provided on a surface thereof with a photosensitive layer, a charging device for having the photosensitive layer charged at a predetermined electric potential, an exposure device for subjecting the photosensitive layer to exposure on the basis of image data to form an electrostatic latent image, and a developing device for adhering toner to the electrostatic latent image on the photosensitive drum to form a toner image, and wherein the plurality of image forming devices are arranged along a straight portion of an endless intermediate transfer belt, which is stretched around a drive roller and a driven roller to revolve, or of a medium conveyance belt in such a manner that each photosensitive drum is in contact with an outer peripheral surface of the straight portion to transfer the toner image formed on the photosensitive drum through the intermediate transfer belt or directly to a medium to form a color image, and wherein each developing device comprises a tip end part and a toner storage part, coupled to the tip end part, to store toner, said tip end part comprising a developing roller in contact with the photosensitive drum to rotate to form a thin toner layer on a surface of the photosensitive drum, a supplying roller for supplying toner to the developing roller, and a toner regulatory blade brought into linear contact with an outer peripheral surface of the developing roller at a predetermined pressure to form a thin toner layer on the surface of the photosensitive drum, and wherein a thickness of the tip end part of each developing device in a direction of movement of the intermediate transfer belt or the medium conveyance belt is smaller than a thickness of the toner storage part in the direction of movement, and wherein each exposure device is arranged near the tip end part of each developing device, each exposure device comprising an LED array arranged in a widthwise direction of an associated photosensitive drum, and wherein a sum of thickness of the tip end part of the developing device and thickness of the toner storage part in the direction of movement of the intermediate transfer belt or the medium conveyance belt is at most 2 times a diameter of the photosensitive drum.

14. The electrophotographic apparatus according to claim 13, wherein in a space formed by the tip end part of the developing device and the toner storage part of the developing device of a first image forming device of said plurality of image forming devices, the exposure device and the charging device of said first image forming device, or the exposure device and the charging device of a second image forming device which is arranged adjacent to said first image forming device for a different color are arranged.

15. The electrophotographic apparatus according to claim 13, wherein the tip end part of the developing device is fixed to a body of the electrophotographic apparatus and only the toner storage part of the developing device is detachably mounted in the body of the electrophotographic apparatus.

16. The electrophotographic apparatus according to claim 14, wherein the tip end part of the developing device is fixed to a body of the electrophotographic apparatus and only the toner storage part of the developing device is detachably mounted in the body of the electrophotographic apparatus.

* * * * *